US007832853B2

(12) United States Patent
Nakashima

(10) Patent No.: US 7,832,853 B2
(45) Date of Patent: Nov. 16, 2010

(54) INKJET PRINTER HAVING CONVEYOR BELT WITH REINFORCED INK RECEIVING GROOVE

(75) Inventor: Atsuhisa Nakashima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 628 days.

(21) Appl. No.: 11/360,696

(22) Filed: Feb. 24, 2006

(65) Prior Publication Data

US 2006/0139431 A1 Jun. 29, 2006

Related U.S. Application Data

(62) Division of application No. 10/876,660, filed on Jun. 28, 2004, now Pat. No. 7,036,922.

(30) Foreign Application Priority Data

Jun. 30, 2003 (JP) ..... 2003-188993

(51) Int. Cl.
*B65H 5/02* (2006.01)

(52) U.S. Cl. ..... 347/104; 271/198; 271/275

(58) Field of Classification Search ..... None
See application file for complete search history.

(56) References Cited

U.S. PATENT DOCUMENTS

| | | | | |
|---|---|---|---|---|
| 4,207,578 | A * | 6/1980 | Marinoff | 347/104 |
| 5,040,000 | A | 8/1991 | Yokoi | |
| 5,051,761 | A | 9/1991 | Fisher et al. | |
| 5,517,222 | A * | 5/1996 | Sugiyama et al. | 347/104 |
| 6,402,292 | B1 | 6/2002 | Ninomiya | |
| 6,672,705 | B2 | 1/2004 | Kitahara et al. | |
| 6,733,109 | B1 * | 5/2004 | Lorenz et al. | 347/36 |
| 6,846,061 | B2 | 1/2005 | Nakashima | |
| 2003/0128253 | A1 * | 7/2003 | Kitahara et al. | 347/104 |
| 2004/0100544 | A1 | 5/2004 | Okamoto et al. | |
| 2004/0228669 | A1 | 11/2004 | Nakashima et al. | |
| 2004/0246324 | A1 * | 12/2004 | Nakashima | 347/104 |
| 2005/0024464 | A1 * | 2/2005 | Takagi | 347/104 |

FOREIGN PATENT DOCUMENTS

| | | |
|---|---|---|
| JP | A-2-48958 | 2/1990 |
| JP | A-3-187762 | 8/1991 |
| JP | A-5-131618 | 5/1993 |
| JP | A-9-109377 | 4/1997 |
| JP | A-11-198395 | 7/1999 |
| JP | A-2000-272110 | 10/2000 |
| JP | A-2001-287377 | 10/2001 |

* cited by examiner

*Primary Examiner*—Jill E Culler
(74) *Attorney, Agent, or Firm*—Oliff & Berridge, PLC

(57) ABSTRACT

An inkjet printer includes a pair of rollers whose axes of rotation are parallel to each other. An endless conveyor belt is stretched between the pair of rollers. The conveyor belt conveys a print medium in the conveyance direction attendant upon rotations of the pair of rollers. The conveyor belt has, on its outer circumferential surface, an ink receiving groove extending in a direction intersecting the conveyance direction. The depth of the ink receiving groove gradually increases toward the center of the ink receiving groove in the conveyance direction in at least one of regions continuous from front and rear ends of the ink receiving groove in the conveyance direction.

15 Claims, 14 Drawing Sheets

INKJET PRINTER HAVING CONVEYOR BELT WITH REINFORCED INK RECEIVING GROOVE

This is a Division of application Ser. No. 10/876,660 filed Jun. 28, 2004. The entire disclosure of the prior application is hereby incorporated by reference herein in its entirety.

BACKGROUND OF THE INVENTION

1. Field of the Invention

The present invention relates to an inkjet printer having therein a conveyor belt for conveying a print medium.

2. Description of the Related Art

JP-A-2000-272110 discloses a fixed-line head inkjet printer in which a recording paper is conveyed by using a conveyor belt stretched between two rollers. In the inkjet printer, ink is ejected toward the outer circumferential surface of the conveyor belt in ink preliminary ejection, so-called flushing, which is carried out for maintaining good ink ejection performance. The ink ejected onto the conveyor belt by flushing is absorbed by a cleaning roller and thereby removed from the conveyor belt. In the inkjet printer used is an endless conveyor belt the whole outer circumferential surface of which is even. Thus, the area to which ink is to be ejected by flushing need not be restricted to a specific area on the outer circumferential surface of the belt. Ink may be ejected by flushing to any area being covered with no recording paper. This can shorten the total time required for flushing operations. However, ink adhering to the conveyor belt is hard to be completely removed with such a cleaning roller. Therefore, when a recording paper is put on the outer circumferential surface of the belt in an area to which ink has been ejected by flushing, the recording paper may be dirtied by transfer of ink. Evenness of the outer circumferential surface of the belt may cause an increase in the quantity of ink transferred from the conveyor belt to the recording paper. This is for the following reason. On such an even outer circumferential surface of the belt, ink having been ejected onto the belt is apt to spread over a broad area. As a result, a large quantity of ink that can not be removed with a cleaning roller is left on the conveyor belt.

JP-A-2001-287377 discloses a fixed-line head inkjet printer having therein a conveyor belt having an opening. In this inkjet printer, ink is ejected by flushing toward a capping member provided separately from the conveyor belt through the opening. Thus, the ink can not adhere to the outer circumferential surface of the belt. This prevents a recording paper from being dirtied by transfer of ink from the conveyor belt.

However, provision of such an opening in the conveyor belt may cause variation of conveyance speed of a recording paper being conveyed by the conveyor belt when the opening passes on a roller. This may bring about deterioration of print quality.

SUMMARY OF THE INVENTION

An object of the present invention is to provide an inkjet printer wherein a print medium is hard to be dirtied by transfer of ink from the outer circumferential surface of a conveyor belt, and deterioration of print quality due to variation of the conveyance speed of the print medium is hard to occur.

An inkjet printer of the present invention comprises an inkjet head, a pair of rollers whose axes of rotation are parallel to each other, and an endless conveyor belt stretched between the pair of rollers for conveying a print medium in the conveyance direction attendant upon rotations of the pair of rollers. According to an aspect of the present invention, the conveyor belt has, on its outer circumferential surface, an ink receiving groove extending in a direction intersecting the conveyance direction. The ink receiving groove receives ink ejected in ink preliminary ejection for ejecting ink preliminarily from the inkjet head. The depth of the ink receiving groove gradually increases toward the center of the ink receiving groove in the conveyance direction in at least one of regions continuous from front and rear ends of the ink receiving groove in the conveyance direction.

According to another aspect of the present invention, the thickness of the conveyor belt in the region of the ink receiving groove gradually decreases from the front and rear ends of the ink receiving groove in the conveyance direction toward the center of the ink receiving groove in the conveyance direction.

According to still another aspect of the present invention, the ink receiving groove has a reinforcing member disposed in at least one of regions continuous from the front and rear ends of the ink receiving groove in the conveyance direction.

According to still another aspect of the present invention, the conveyor belt comprises an endless base sheet, one or more outer circumferential sheets the length of each of which along the conveyance direction is smaller than the outer circumferential length of the base sheet, and one or more reinforcing members. The one or more outer circumferential sheets are bonded such that two ends of the outer circumferential sheet or sheets in the conveyance direction are distant from each other. The one or more reinforcing members are bonded to the portion of the outer circumferential surface of the base sheet not covered with the outer circumferential sheet or sheets between the two ends of the outer circumferential sheet or sheets in at least one of regions continuous from front and rear ends of the outer circumferential sheet or sheets in the conveyance direction.

According to still another aspect of the present invention, the conveyor belt comprises a reinforcing member extending in the conveyance direction across the ink receiving groove and having a constant strength along the conveyance direction.

According to the invention, the print medium is hard to be dirtied by transfer of ink from the outer circumferential surface of the conveyor belt, and deterioration of print quality due to variation of the conveyance speed of the print medium is hard to occur.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

Whole Construction

Figure 1:
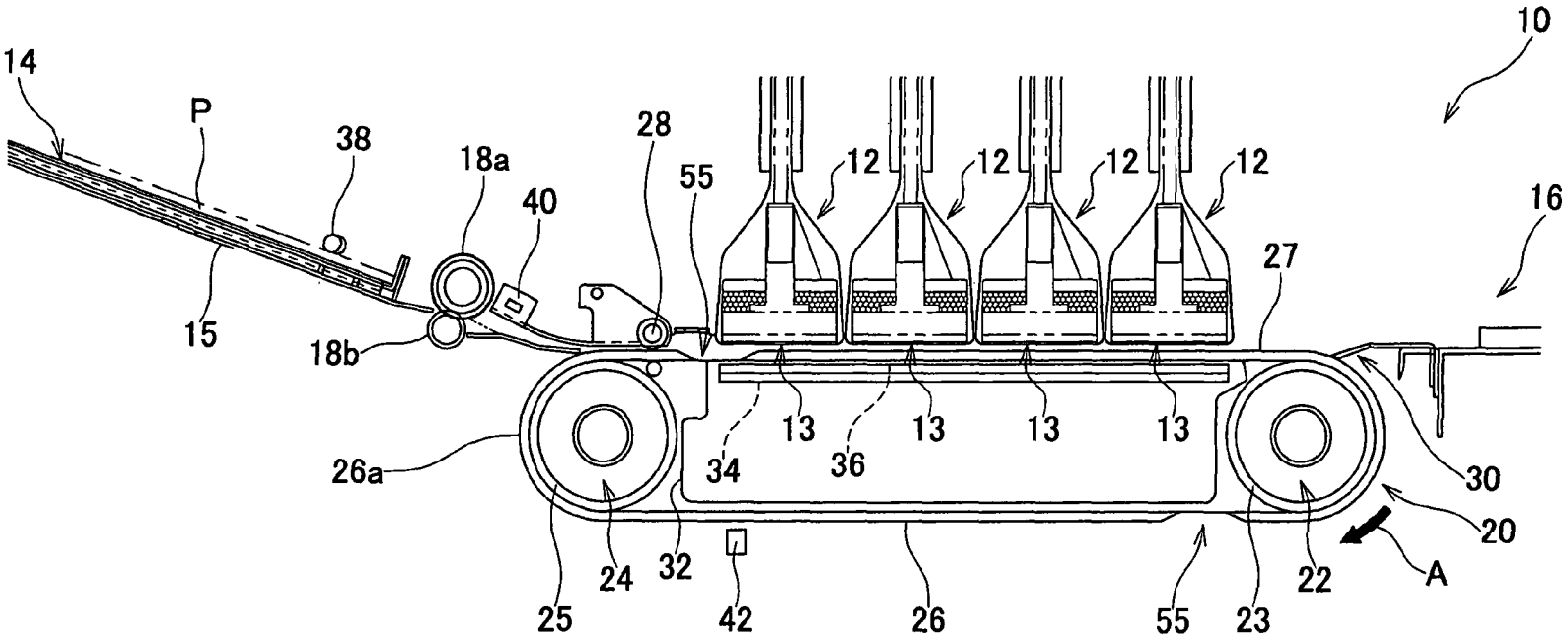
FIG. 1 is a side view showing the whole construction of an inkjet printer according to a first embodiment of the present invention.

First, the whole construction of an inkjet printer according to a first embodiment of the present invention will be described with reference to FIG. 1. The inkjet printer 10 shown in FIG. 1 is a line head color inkjet printer having therein four fixed inkjet heads 12. Each inkjet head 12 is rectangular in plane, oblong perpendicularly to FIG. 1. within the printer 10 provided are a paper feeder 14 in the left of FIG. 1, a paper stacker 16 in the right of FIG. 1, and a conveyor unit 20 in the middle of FIG. 1.

The paper feeder 14 includes a paper tray 15 and a pickup roller 38. The paper tray 15 can receive thereon a stack of rectangular cut sheets P of paper. The pickup roller 38 sends the uppermost one of the cut sheets P on the paper tray 15 toward the conveyor unit 20 one by one. The paper tray 15 receives thereon the cut sheets P such that each cut sheet P can be sent parallel to its longer sides. A pair of feed rollers 18*a* and 18*b* are disposed between the paper tray 15 and the conveyor unit 20. Each cut sheet P discharged from the paper feeder 14 is driven to the right of FIG. 1 by the feed rollers 18*a* and 18*b* in a state that one shorter side of the cut sheet P is the leading edge.

The axis of rotation of the pickup roller 38 is inclined by three degrees relatively to a straight line perpendicular to an inner side wall of the paper tray 15 such that the distance of the axis from the conveyor unit 20 decreases as the distance from the inner side wall increases. Thus, each cut sheet P picked up by the pickup roller 38 is advanced in a direction somewhat oblique to the inner side wall of the paper tray 15 so that one longer side of the cut sheet P is forcibly brought near to the inner side wall of the paper tray 15. The inner side wall of the paper tray 15 is parallel to the conveyance direction of the cut sheet P by the conveyor unit 20. The one longer side of the cut sheet P comes into contact with the inner side wall of the paper tray 15 before one shorter side of the cut sheet P as the leading edge reaches the feed rollers 18*a* and 18*b*. Thereafter, the cut sheet P is advanced along the inner side wall of the paper tray 15 toward the feed rollers 18*a* and 18*b* in a state that the one longer side of the cut sheet P is in contact with the inner side wall of the paper tray 15. By the above-described simple configuration in which the pickup roller 38 is inclined relatively to the inner side wall of the paper tray 15, oblique movement of each cut sheet P can be rectified with ensuring continuous feed of cut sheets P. The cut sheet P pinched by the feed rollers 18*a* and 18*b* is driven toward the conveyor unit 20.

The conveyor unit 20 includes an endless conveyor belt 26 and two belt rollers 22 and 24 on which the belt 26 is wrapped. The length of the belt 26 is regulated so that a predetermined tension is generated on the belt 26 stretched between the belt rollers 22 and 24. On the belt 26 being stretched between the belt rollers 22 and 24, there are formed two planes parallel to each other, each including a common tangent line to the belt rollers 22 and 24. One of the two planes opposite to the heads 12 functions as the conveyance surface 27 for cut sheets P. Each cut sheet P fed from the paper feeder 14 is conveyed on the conveyance surface 27 of the conveyor belt 26 while printing by the inkjet heads 12 is performed on the upper face, i.e., print face, of the cut sheet P. The cut sheet P then reaches the paper stacker 16. On the paper stacker 16, printed cut sheets P are stacked.

As shown in FIG. 1, two ink receiving grooves 55 trapezoidal in section along the length of the belt 26, i.e., along the conveyance direction, are formed on the outer circumferential surface 26*a* of the belt 26. Ink is ejected from each inkjet head 12 by flushing toward the inner surface of an ink receiving groove 55. Details of the ink receiving groove 55 will be described later.

(Details of Heads)

Each of the four inkjet heads 12 has at its lower end portion a head main body 13. The head main body 13 includes a flow passage unit and an actuator unit bonded to each other though both of them are not clearly shown in any drawing. In the flow passage unit formed are a large number of ink flow passages each including a pressure chamber connected to a nozzle. The actuator unit can apply pressure to ink in desired ones of the pressure chambers. The flow passage unit is made up of layered metallic sheets in some of which holes are formed. The actuator unit includes piezoelectric sheets, at least one of which is sandwiched by electrodes.

Each head main body 13 has a rectangular parallelepiped shape in plane, slender perpendicularly to FIG. 1. Four head main bodies 13 are arranged horizontally in FIG. 1 at short intervals. A large number of small-diameter ink ejection ports each functioning as a nozzle are formed in the ink ejection face, i.e., a face confronting the belt 26, of each of the four head main bodies 13. Each ink ejection port ejects ink of one color of magenta (M), yellow (Y), cyan (C), and black (K). The ink ejection ports of one head main body 13 eject the same color of ink. The four head main bodies 13 eject, through their ink ejection ports, inks different in color from one another, selected out of magenta, yellow, cyan, and black.

A narrow space is formed between the bottom face of each head main body 13 and the conveyance surface 27 of the conveyor belt 26. Each cut sheet P is conveyed on a conveyance path extending through the space from the left to the right in FIG. 1. While the cut sheet P on the conveyance path is passing under the four head main bodies 13 in order, inks are ejected from ink ejection ports toward the upper face of the cut sheet P in accordance with image data to form a desired color image on the cut sheet P.

(Details of Conveyor Unit)

The outer circumferential surface 26*a* of the conveyor belt 26 except the regions of the ink receiving grooves 55 has been treated with silicone rubber. Thus, the conveyor unit 20 can hold each cut sheet P, which has been fed by the pair of feed rollers 18*a* and 18*b*, on the outer circumferential surface 26*a* of the conveyor belt 26 by the adhesion of the surface 26*a*. In this state, the conveyor unit 20 can convey the cut sheet P toward the paper stacker 16 by one belt roller 22 rotating clockwise as shown by an arrow A in FIG. 1.

Figure 2:
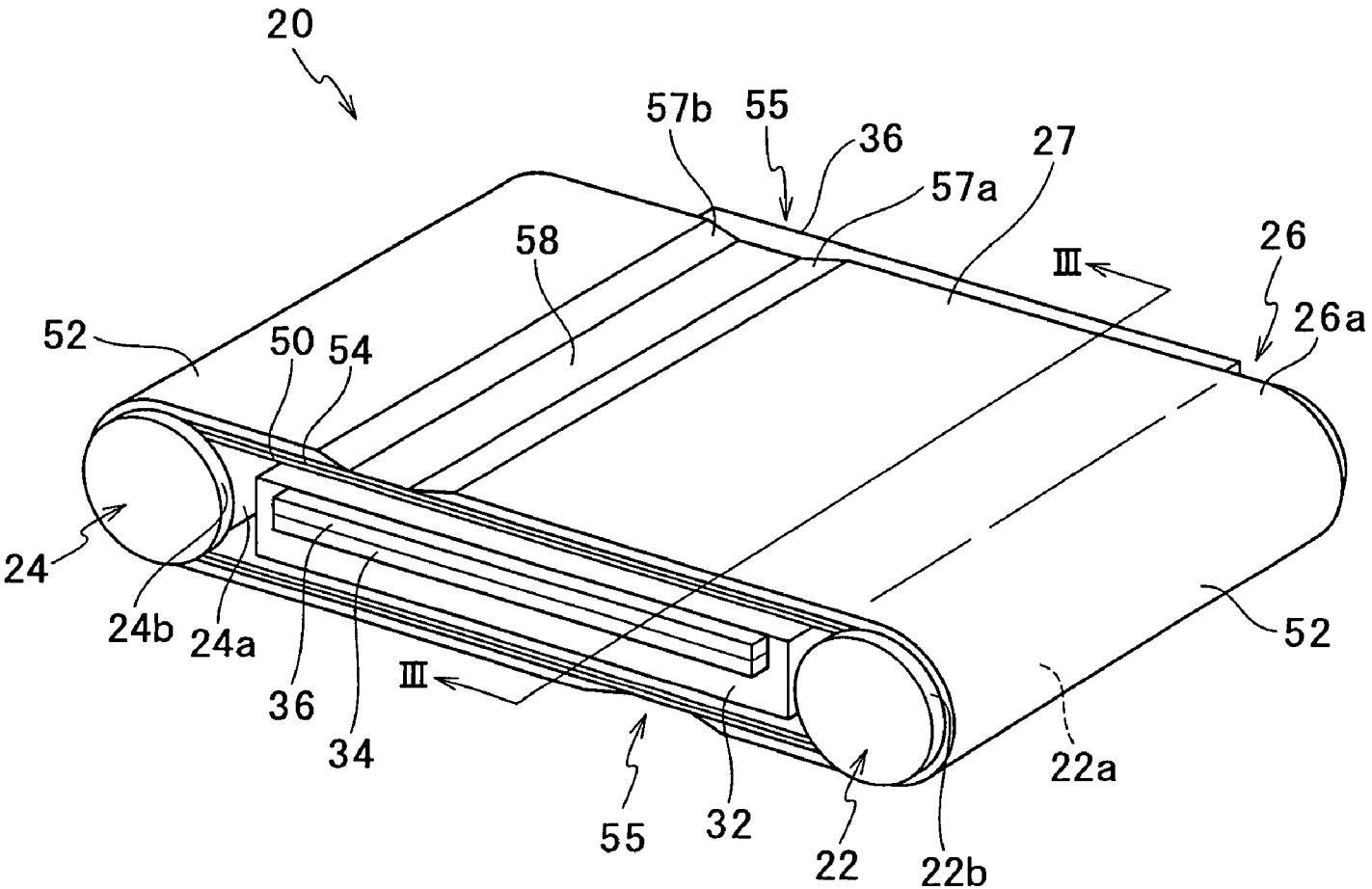
FIG. 2 is a general perspective view of a conveyor unit included in the inkjet printer of FIG. 1.
Figure 3:
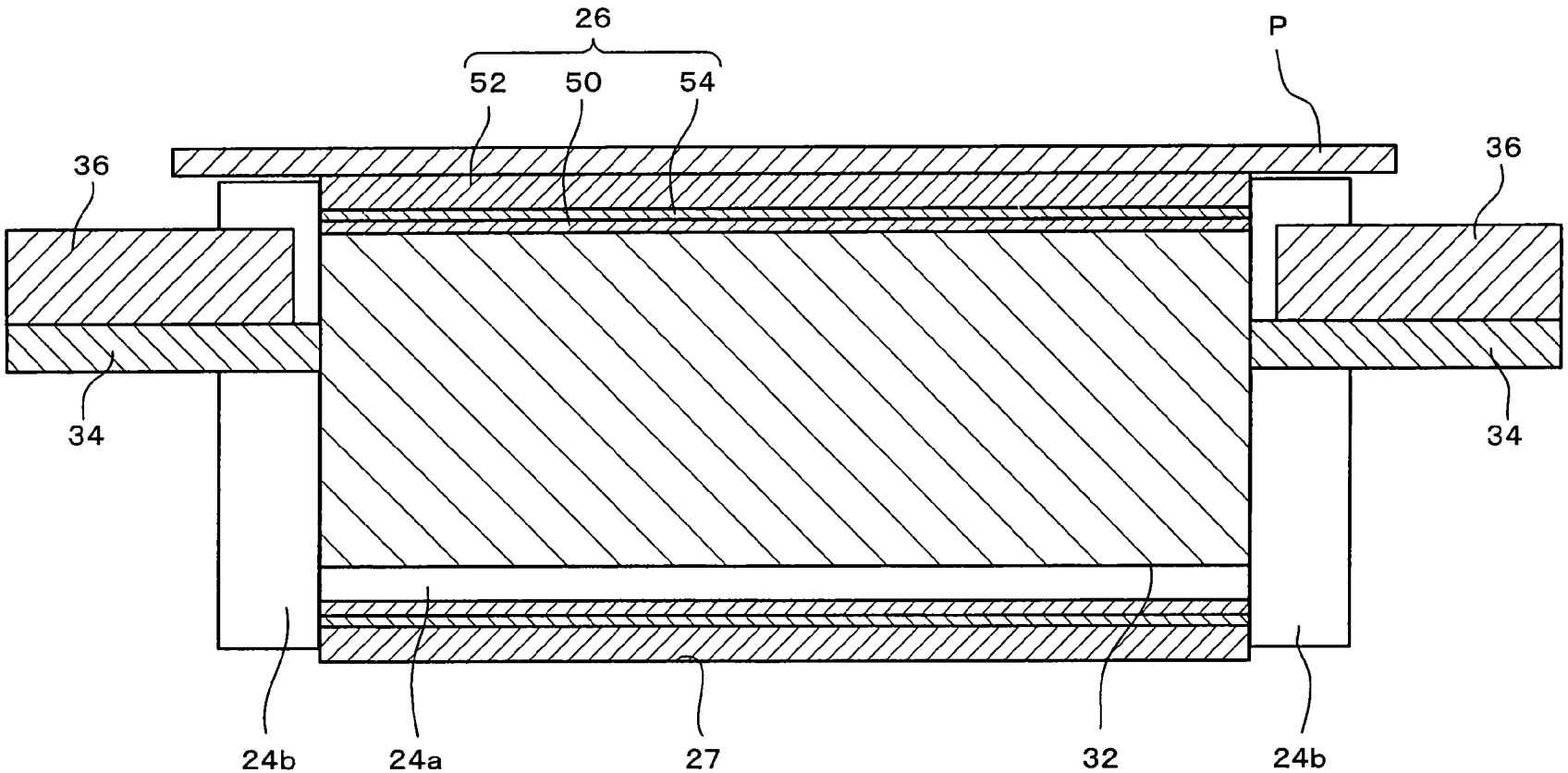
FIG. 3 is a sectional view taken along line III-III in FIG. 2.

FIG. 2 shows a perspective view of the conveyor unit 20. FIG. 3 shows a sectional view taken along line III-III in FIG. 2. As shown in FIGS. 2 and 3, two belt rollers 22 and 24 are made up of cylinders 22*a* and 24*a* and flanges 22*b* and 24*b* formed at both ends of the cylinders 22*a* and 24*a*, respectively. Each of the cylinders 22*a* and 24*a* is in contact with the inner circumferential surface 26, shown in FIG. 4B, of the conveyor belt 26. Each of the flanges 22*b* and 24*b* has its radius substantially equal to the sum of the thickness of the conveyor belt 26 and the radius of each of the cylinders 22*a* and 24*a*. Of the two belt rollers 22 and 24 of the conveyor unit 20, the belt roller 22 downstream in the conveyance path is connected to a conveyance motor 74 shown in FIG. 5. The conveyance motor 74 is driven under the control of a controller 60 shown in FIG. 5. The other belt roller 24 is a follower, which is rotated by a rotational force applied from the conveyor belt 26 attendant upon the rotation of the belt roller 22.

Referring back to FIG. 1, a pressing roller 28 is disposed at a position on the side of the conveyor path opposite to the belt roller 24. The pressing roller 28 includes a cylinder freely rotatable, the length of which is substantially equal to the axial length of the belt roller 24. The pressing roller 28 is biased downward by a not-shown spring so that the pressing roller 28 can press a cut sheet P, supplied onto the conveyor unit 20, onto the conveyance surface 27. Thus, the cut sheet P can surely adhere to the conveyance surface 27. If the pressing roller 28 moves downward by a predetermined distance, it is stopped by a not-shown stopper. Therefore, the pressing roller 28 never falls within any ink receiving groove 55.

A peeling plate 30 is provided in the right of the conveyor unit 20 in FIG. 1. The peeling plate 30 interposes from its left end between the conveyor belt 26 and a cut sheet P adhering to the conveyance surface 27 of the conveyor belt 26 to peel the cut sheet P off the conveyor surface 27.

As shown in FIG. 1, a substantially rectangular parallelepiped guide block 32 is disposed within a region surrounded by the conveyor belt 26. As is apparent from FIGS. 2 and 3, the guide block 32 has substantially the same width as the conveyor belt 26. The upper face of the guide block 32 is flat and in contact with the inner circumferential surface 26*b* of the conveyor belt 26 in the region opposite to the inkjet heads 12.

Support plates 34 protrude from both side faces of the guide block 32 perpendicularly to the conveyance direction, i.e., along the width of the conveyor belt 26. Each support plate 34 has its length substantially equal to the total length of the four head main bodies 13 along the conveyance path. The upper face of each support plate 34 is covered with a rectangular parallelepiped ink-absorbing member 36. The distance of the upper face of each ink-absorbing member 36 from the ink ejection face of each head main body 13 is set to be sufficiently short so that ink droplets ejected outside a cut paper P upon printing may impact the ink-absorbing member 36 in high probability. More specifically, the distance is preferably 4 mm to 8 mm. Thereby, because fine ink droplets little fly within the printer casing, cut sheets P and parts within the printer casing can be prevented from being dirtied by ink.

(Position Detecting Mechanisms)

As shown in FIG. 1, a paper sensor 40 is disposed between a feed roller 18*a* and the pressing roller 28. The paper sensor 40 is a photo sensor made up of a light emitting element and a light receiving element. In the paper sensor 40, the light emitting element emits light toward a detection position on the conveyance path, and the light receiving element receives a reflected light. The level of the signal being output from the paper sensor 40 reflects the difference in intensity of the reflected light in accordance with whether a cut sheet P exists on the detection position. More specifically, it is known that the leading edge of a cut sheet P reached the detection position at the time when the level of the output signal sharply increased.

A conveyor belt position detecting sensor 42, which is a photo sensor made up of a light emitting element and a light receiving element, is disposed under the conveyor unit 20 adjacent to the outer circumferential surface 26*a* of the conveyor belt 26. In the conveyor belt position detecting sensor 42, the light emitting element emits light toward a detection position on the outer circumferential surface 26*a* of the conveyor belt 26, and the light receiving element receives a reflected light. Detection zones higher in optical reflectance than the surroundings are provided at portions on the outer circumferential surface 26*a* of the conveyor belt 26 somewhat apart from each ink receiving groove 55 though the detection zones are not shown in any drawing. The level of the signal being output from the conveyor belt position detecting sensor 42 reflects the difference between the reflected light from such a detection zone and the reflected light from another portion. More specifically, it is known that the leading edge of an ink receiving groove 55 reached a predetermined position near the sensor 42 at the time when the level of the output signal sharply increased.

(Construction of Conveyor Belt)

Figure 4A:
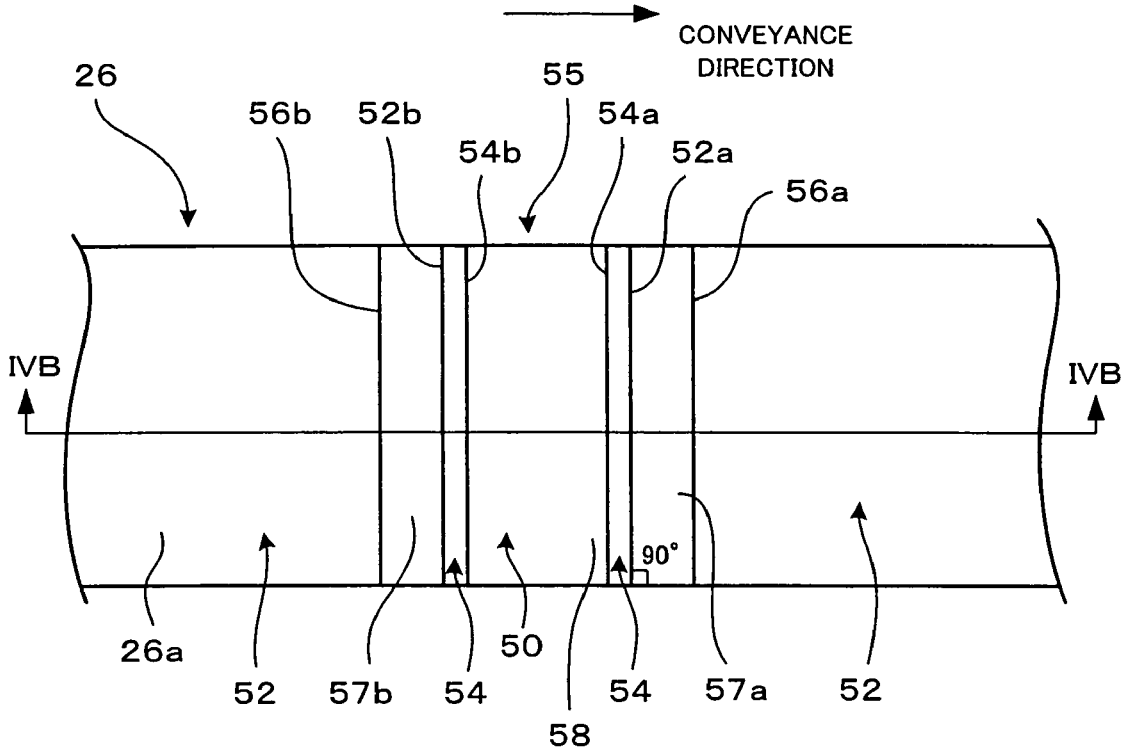
FIG. 4A is a plan view of a conveyor belt in FIG. 2 in the vicinity of an ink receiving groove.
Figure 4B:
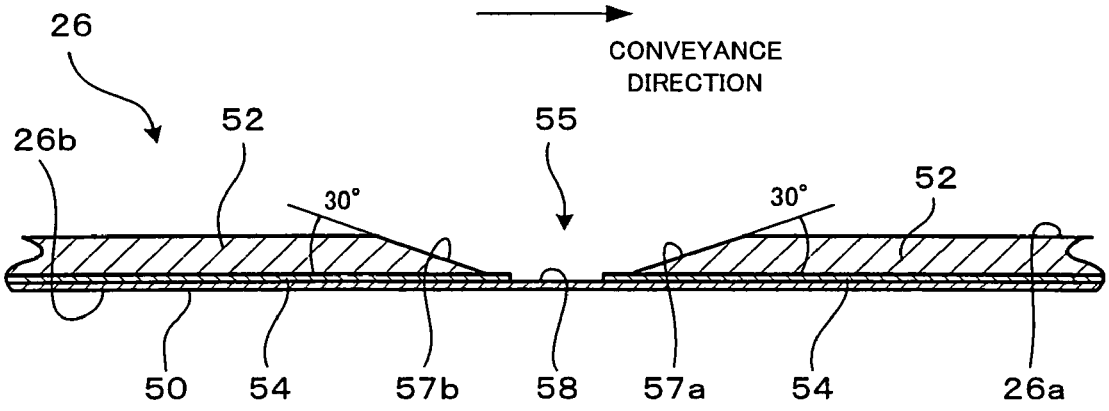
FIG. 4B is a sectional view taken along line IVB-IVB in FIG. 4A.

The conveyor belt 26 will be further described with reference to FIGS. 4A and 4B. FIG. 4A shows a plan view of the conveyor belt 26 in the vicinity of an ink receiving groove 55. FIG. 4B shows a sectional view of the conveyor belt 26 along the conveyance direction in the vicinity of the ink receiving groove 55. As shown in FIG. 4B, except the region of the ink receiving groove 55, the conveyor belt 26 has a three-layer structure of an endless base sheet 50 forming the inner circumferential surface 26*b* of the belt 26, an elastic sheet 52 forming the outer circumferential surface 26*a* of the belt 26, and an adhesive layer 54 bonding the two sheets 50 and 52 to each other. As shown in FIG. 2, two separate elastic sheets 52 are bonded to the outer circumferential surface of the base sheet 50. The total length of the two elastic sheets 52 is almost equal to the sum of the outer circumferential length of the base sheet 50 and the lengths of two ink receiving grooves 55 along the conveyance direction.

The base sheet 50 is made of a 0.2 mm-thick nonwoven fabric impregnated with polyurethane. Alternatively, the base sheet 50 may be made of a woven or nonwoven fabric impregnated with polyester.

Each elastic sheet 52 bonded to the outer circumferential surface of the base sheet 50 is made of silicone rubber. The thickness of the elastic sheet 52 is 1.5 mm. Alternatively, each elastic sheet 52 may be made of another elastic material such as EPDM, urethane rubber, or butyl rubber. The strength of the elastic sheet 52 is smaller than that of the base sheet 50.

The adhesive layer 54 is made of a silicone-base single liquid type moisture setting elastic adhesive having elasticity even after being dried, and having its elongation of 280%. The thickness of the adhesive layer 54 is 0.07 mm. As the adhesive used for the adhesive layer 54, any suitable one can properly be selected out of known adhesives in consideration of adaptability to the base sheet 50 and the elastic sheet 52, and desired elasticity. Alternatively, the adhesive layer 54 may be made of a two-sided adhesive tape resistive to ink. Further, in case that the base sheet 50 and the elastic sheet 52 are sewed to each other with threads or bonded to each other by thermocompression, such an adhesive layer 54 need not be used for bonding the base sheet 50 and the elastic sheet 52 to each other.

As shown in FIG. 4A, each ink receiving groove 55 is formed over the width of the conveyor belt 26. The respective rear and front edges 52*a* and 52*b* of the elastic sheets 52 in the conveyor direction form straight lines extending along the width of the belt 26 and parallel to each other. In the vicinity of each of the edges 52*a* and 52*b*, a taper face is formed that has a constant width and is inclined outward at an angle of 30 degrees. Two elastic sheets 52 are disposed such that the opposed edges 52*a* and 52*b* in each pair are distant from each other. Each end portion of the adhesive layer 54 interposed between the elastic sheets 52 and the base sheet 50 protrudes beyond the corresponding edge 52*a* or 52*b* into the corresponding ink receiving groove 55. Because each extension of the adhesive layer 54 beyond the edge 52*a* or 52*b* is very short, the taper face in the vicinity of the edge 52*a* or 52*b* of each elastic sheet 52 forms an actual end face of the corresponding ink receiving groove 55. Such end faces of each ink receiving groove 55 corresponding to the respective edges 52*a* and 52*b* will be referred to as receiving groove end faces 57*a* and 57*b*. Each portion of the outer circumferential surface of the base sheet 50 exposed between parts of the adhesive layer 54 forms the bottom face of the corresponding ink receiving groove 55. The bottom face of each ink receiving groove 55 will be referred to as receiving groove bottom face 58. The inclination angle of the receiving groove end faces 57*a* and 57*b* may be adequately changed. However, the inclination angle is preferably 45 degrees or less.

Front and rear ends 56*a* and 56*b* defining the region of each ink receiving groove 55 extend along the width of the belt 26. The ends 56*a* and 56*b* form the border lines between the respective receiving groove end faces 57*a* and 57*b* and the outer circumferential surface 26*a* of the belt 26. The thickness of the belt 26 in each ink receiving groove 55 is the largest at the ends 56*a* and 56*b*. The thickness linearly decreases in the regions of the receiving groove end faces 57*a* and 57*b* from the ends 56*a* and 56*b* to the edges 52*a* and 52*b*. In the regions from the edges 52*a* and 52*b* to the edges 54*a* and 54*b* of the adhesive layer 54, the thickness of the belt 26 is constant as the thickness of the adhesive layer 54. The thickness of the belt 26 then decreases stepwise at the edges 54*a* and 54*b* of the adhesive layer 54 to be equal to the thickness of the base sheet 50. In short, in either of the regions from the front end 56*a* to the edge 52*a* and from the rear end 56*b* to the edge 52*b*, the thickness of the belt 26 in the region of the ink receiving groove 55 gradually decreases toward the center of the ink receiving groove 55 in the conveyance direction, i.e., toward the deepest portion of the ink receiving groove 55.

The strength of the belt 26 along the conveyance direction changes like the thickness of the belt 26. More specifically, the strength of the belt 26 along the conveyance direction is the maximum outside each ink receiving groove 55. The strength linearly decreases in the regions of the receiving groove end faces 57*a* and 57*b* from the ends 56*a* and 56*b* to the edges 52*a* and 52*b*. Therefore, the change in the conveyance speed of a cut sheet P by the belt 26 when an ink receiving groove 55 passes on the belt roller 22 or 24 attendant upon the rotation of the belt 26 becomes dull in comparison with a case wherein the receiving groove end faces 57*a* and 57*b* are not taper faces. This is supposed to be the following reason. That is, because the change in the strength of the belt 26 along the conveyance direction is dull, the change in the turning load on the belt roller 22 or 24 becomes dull when the ink receiving groove 55 passes on the belt roller 22 or 24. Because the change in the conveyance speed becomes dull, mackle in an image printed on a cut sheet P becomes hard to be conspicuous.

In addition, because the adhesive layer 54 extends beyond the edges 52*a* and 52*b* into each ink receiving groove 55, the distance from the ends 56*a* and 56*b*, where the strength in the ink receiving groove 55 is the maximum, to the edges 54*a* and 54*b* of the adhesive layer 54, where the strength is the minimum, is increased by the extension of the adhesive layer 54 into the ink receiving groove 55. This means that the change in the strength along the length of the conveyor belt 26 in the ink receiving groove 55 becomes duller because the adhesive layer 54 extends into the ink receiving groove 55. In this embodiment, therefore, the change in the conveyance speed of a cut sheet P when the ink receiving groove 55 passes on a belt roller 22 or 24 attendant upon the rotation of the belt 26 becomes duller in comparison with a case wherein the adhesive layer 54 does not extend into the ink receiving groove 55.

The inkjet printer 10 is provided with a cleaning roller for removing ink ejected by flushing, from each ink receiving groove 55 though the cleaning roller is not shown in any drawing. An ink absorbing member made of urethane foam is provided on the outer circumferential surface of the cleaning roller. The cleaning roller is supported by a movable supporting member so as to be rotatable around the axis of the cleaning roller. When an ink receiving groove 55 faces downward, the cleaning roller is moved so that its outer circumferential surface comes into contact with the receiving groove bottom face 58 of the ink receiving groove 55. Thereby, ink adhering to the receiving groove bottom face 58 is discharged from the ink receiving groove 55 by the capillary action of the cleaning roller, and absorbed in the cleaning roller. Ink absorbed in the cleaning roller can be removed from the cleaning roller in the manner that the cleaning roller is brought into contact with a not-shown waste liquid foam.

A modification of the present embodiment is now described. As is apparent from FIGS. 2 and 4A, each ink receiving groove 55 is formed over the width of the conveyor belt 26. Therefore, when ink collected in the ink receiving groove 55 is discharged from a side of the conveyor belt 26 by, for example, jetting air, the ink is easy to be discharged.

(Construction of Control System and Outline of Printing Operation)

Figure 5:
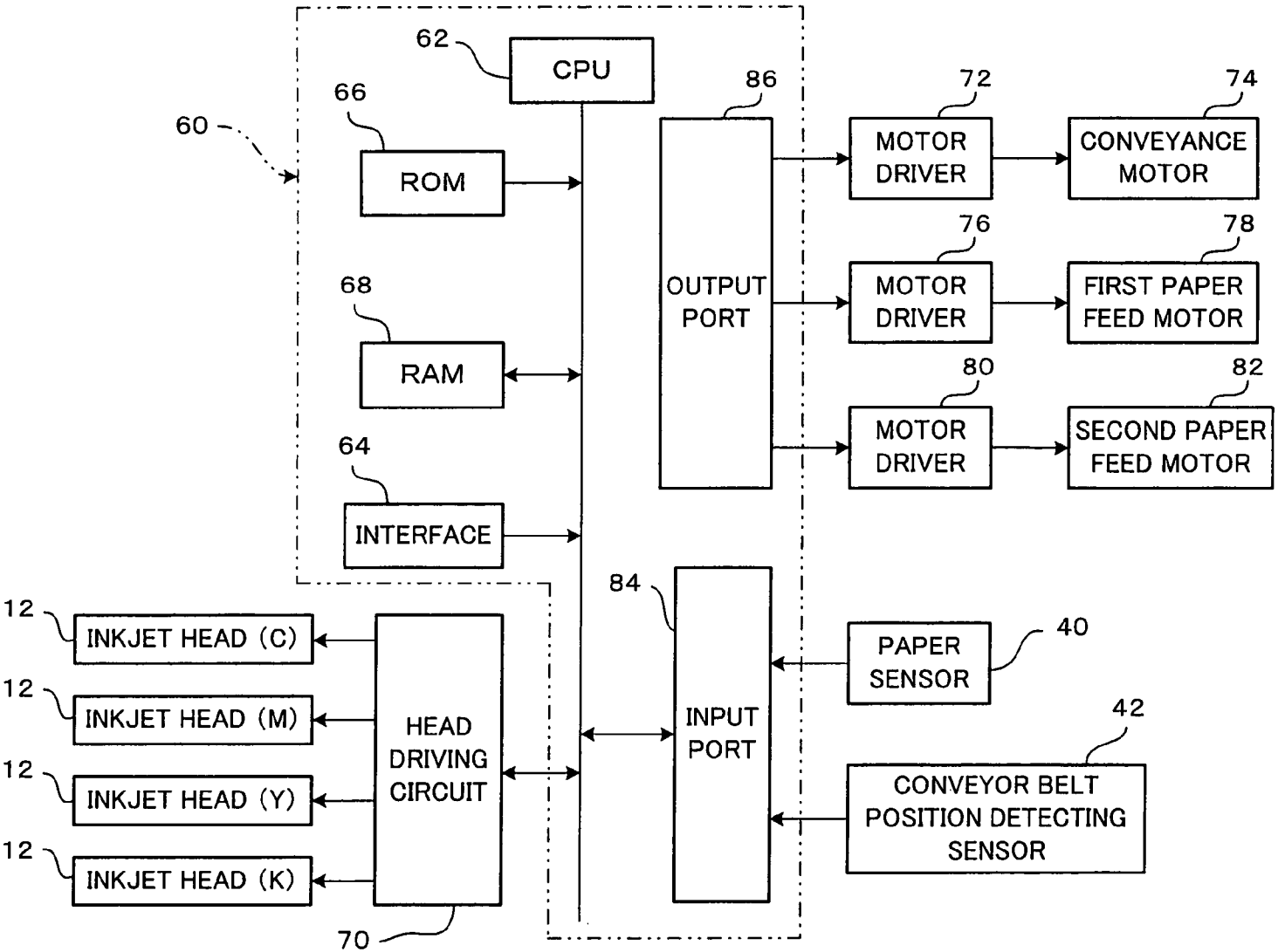
FIG. 5 is a block diagram showing a general electric construction of the inkjet head of FIG. 1.

A control system for controlling the operation of the inkjet printer 10 will be described with reference to FIG. 5. As shown in FIG. 5, a controller provided in the inkjet printer 10 includes a CPU (Central Processing Unit) 62, an interface 64, a ROM 66 storing therein software programs for various operations in the printer 10, a RAM 68 for temporarily storing data, an input port 84, and an output port 86. The output signals from the paper sensor 40 and the conveyor belt position detecting sensor 42 are given to the controller 60 through the input port 84. Three motor drivers 72, 76, and 80 are connected to the output port 86. The controller 60 controls, through the motor driver 72, a conveyance motor 74 for driving the belt roller 22 to apply rotational force to the conveyor belt 26. The controller 60 controls, through the motor driver 76, a first paper feed motor 78 for driving the pickup roller 38. The controller 60 controls, through the motor driver 80, a second paper feed motor 82 for driving the feed rollers 18*a* and 18*b*. Further, a head driving circuit 70 for driving four inkjet heads 12 is connected to the controller 60.

Print data supplied to the interface 64 from an external machine such as a personal computer is stored in the RAM 68. If necessary, the CPU 62 edits the print data by using an image processing program being stored in the ROM 66. The CPU 62 controls the motor driver 76 so that the pickup roller 38 sends out the uppermost cut sheet P on the paper tray 15 toward the conveyor unit 20. Synchronously with this, the CPU 62 controls the motor drivers 72 and 80 so that the belt roller 22 and the feed rollers 18*a* and 18*b* start to rotate. The belt roller 22 continues rotating at a constant speed until a series of image printing operations are completed. The cut sheet P sent out by the pickup roller 38 is pinched by a pair of feed rollers 18*a* and 18*b* in a state that the longer sides of the cut sheet P are parallel to the conveyance direction, and then the cut sheet P is advanced further. When it is known by the output signal from the paper sensor 40 that the leading edge of the cut sheet P has reached the detection position, the CPU 62 controls the motor driver 80 so that the feed rollers 18*a* and 18*b* once stop rotating.

After it is known by the output signal from the conveyor belt position detecting sensor 42 that the front end of an ink receiving groove 55 has reached a predetermined position, the CPU 62 controls the motor driver 80 so as to restart the paper conveyance by the feed rollers 18*a* and 18*b*. The timing for restarting is determined such that the vicinity of the leading edge of the cut sheet P being put on the conveyor belt 26 a little enter the ink receiving groove 55. Therefore, the vicinity of the leading edge of the cut sheet P is scarcely curved downward by its own weight, and thus ink adhering to the ink receiving groove 55 is never transferred to the cut sheet P.

The cut sheet P being put on the conveyor belt 26 is pressed downward by the pressing roller 28, and thereby the cut sheet P is conveyed on the conveyance surface 27 in a state that the cut sheet P adheres to the conveyor belt 26. The CPU 62 controls the head driving circuit 70 so that a color image based on image data stored in the RAM 68 is formed on the cut sheet P. Thereby, ink ejection onto the cut sheet P starts in order from the upstream head 12 and the color image is printed on the cut sheet P. The cut sheet P on which the color image has been printed is peeled off from the conveyor belt 26 by the peeling plate 30 and then reaches the paper stacker 16.

Figure 6:
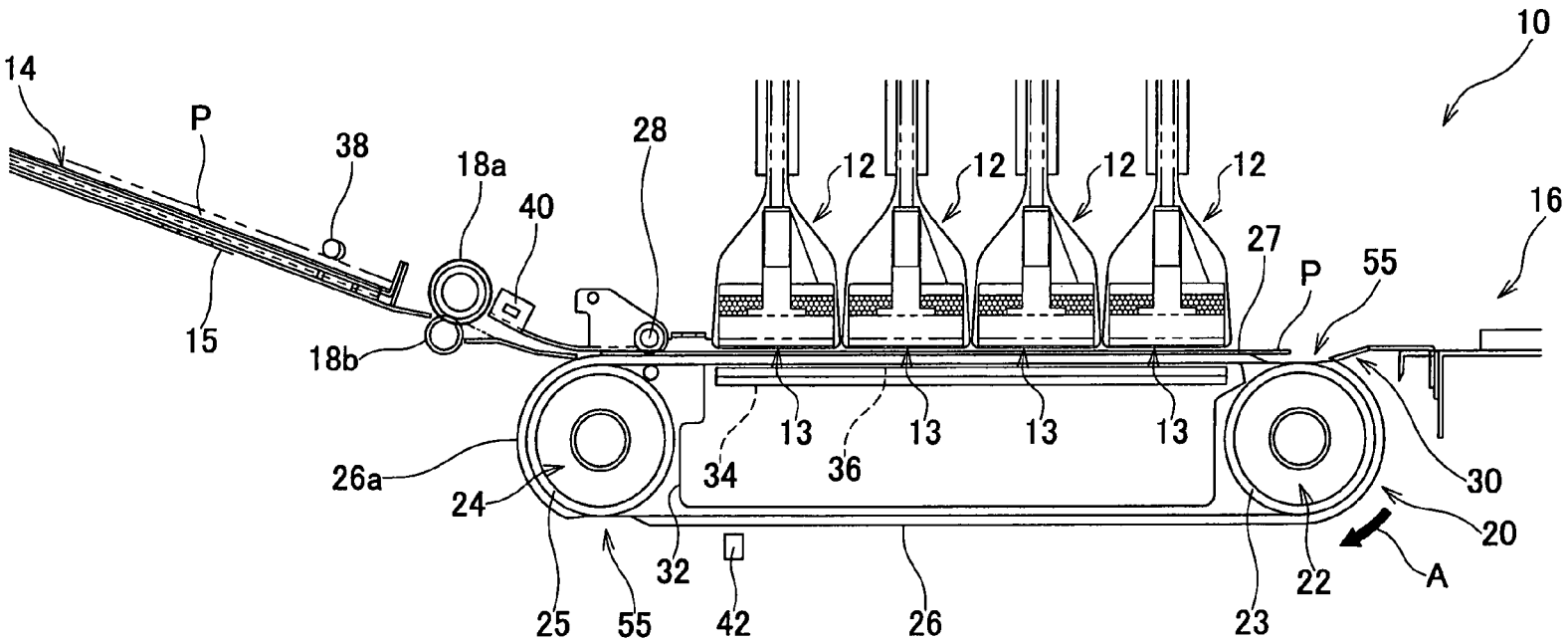
FIG. 6 is a side view showing the whole construction of the inkjet head when the portion of the ink receiving groove of the conveyor belt passes on a belt roller.

As shown in FIG. 6, when an ink receiving groove 55 of the conveyor belt 26 passes on a belt roller 22 or 24 while printing the color image on the cut sheet P, the conveyance speed of the cut sheet P by the conveyor belt 26 varies. Because of this variation, ink droplets impact positions different from the desired positions. In this embodiment, because the receiving groove end faces 57*a* and 57*b* of each ink receiving groove 55 are tapered and the adhesive layer 54 extends into each ink receiving groove 55, the variation rate of the conveyance speed of the cut sheet P is decreased to the degree that mackle in the image is visually negligible.

A flushing operation is carried out while no printing operation onto a cut sheet P is performed, for example, before a printing operation starts or after printing onto a predetermined number of cut sheets P is completed. On the basis of the output signal from the conveyor belt position detecting sensor 42, the CPU 62 controls the head driving circuit 70 such that ink is ejected from each inkjet head 12 by flushing toward the interior of an ink receiving groove 55. Thus, ink never impacts the conveyance surface 27 and ink adhering to the belt 26 is never transferred to a cut sheet P. In addition, because ink ejected in each ink receiving groove 55 scarcely spreads out of the ink receiving groove 55, also from this point, the cut sheet P can be prevented from being dirtied.

In this embodiment, either of the two ends 56*a* and 56*b* defining each ink receiving groove 55 extends along the width of the belt 26. Thus, even when ink ejection ports arranged along the width of the belt 26 eject ink all at once, there is no fear that ink flies to the outside of the target ink receiving groove 55. As a result, control of ink ejection upon flushing is easy.

Second to Sixth Embodiments

Second to sixth embodiments of the present invention will be described. In any of the embodiments, a conveyor belt includes a base sheet and an elastic sheet, like that of the first embodiment. The inkjet printers of the second to sixth embodiments differ from the printer of the first embodiment only in construction of the conveyor belt. Thus, in each of the second to sixth embodiments, the construction of the conveyor belt will be mainly described, and the description of the feature common to the first embodiment will be omitted. In any of the second to sixth embodiments, each ink receiving groove is formed over the width of the conveyor belt.

Figure 7A:
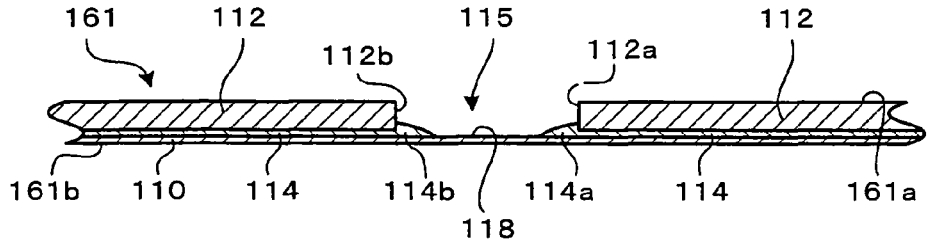
FIGS. 7A to 7E are partial sectional views of conveyor belts along their lengths included in inkjet printers according to second to sixth embodiments of the present invention, respectively.

FIG. 7A shows a partial sectional view of a conveyor belt, along the conveyance direction, included in an inkjet printer according to a second embodiment of the present invention. The conveyor belt 161 of FIG. 7A has two ink receiving grooves 115 though only one of them is shown in FIG. 7A. Except the region of each ink receiving groove 115, the conveyor belt 161 has a three-layer structure of an endless base sheet 110 forming the inner circumferential surface 161*b* of the belt 161, an elastic sheet 112 forming the outer circumferential surface 161*a* of the belt 161, and an adhesive layer 114 bonding the two sheets 110 and 112 to each other. The adhesive forming the adhesive layer 114 is made of an elastic material.

The end faces 112*a* and 112*b* of two elastic sheets 112 opposed to each other stand perpendicularly to the base sheet 110. End portions of the adhesive layer 114 interposed between the elastic and base sheets 112 and 110 extends beyond the end faces 112*a* and 112*b* over the width of the elastic sheets 112, into each ink receiving groove 115. The extensions 114*a* and 114*b* of the adhesive layer 114 each have a somewhat protuberant shape. The two extensions 114*a* and 114*b* are distant from each other. Thus, the outer circumferential surface of the base sheet 110 is exposed between the extensions 114*a* and 114*b*. The exposed portion of the outer circumferential surface of the base sheet 110 forms the bottom face of each ink receiving groove 115, i.e., the receiving groove bottom face 118.

In this embodiment, because the end portions of the adhesive layer 114 extends as the extensions 114*a* and 114*b* into each ink receiving groove 115, the portions near the front and rear ends of the ink receiving groove 115 are reinforced thereby. Thus, the thickness and strength of the conveyor belt 161 along the conveyance direction do not sharply change at both end portions of each elastic sheet 112. As a result, the change in the conveyance speed of a cut sheet P by the belt 161 when an ink receiving groove 115 passes on a belt roller 22 or 24 attendant upon the rotation of the belt 161 is dull in comparison with a case wherein the end portions of the adhesive layer 114 do not extend into each ink receiving groove 115. Because the change in the conveyance speed is dull, mackle in an image printed on a cut sheet P becomes hard to be conspicuous. In addition, because the adhesive layer 114 is used for reinforcing the belt 161, there is a merit that the number of parts can be reduced. Further, because the adhesive forming the adhesive layer 114 has elasticity, the strength of the belt 161 at the portions of the extensions 114*a* and 114*b* is not unnecessarily increased. Thus, the change in the strength can be duller.

A similar effect of making the change in the conveyance speed dull can be obtained even in case that the adhesive layer 114 extends into each ink receiving groove 115 from only one of the front and rear ends of the ink receiving groove 115. In another modification, the adhesive layer 114 may extend into each ink receiving groove 115 beyond an end of an elastic sheet 112 partially in the width of the elastic sheet 112. In such a case, the adhesive layer 114 may have extensions separate in the width of the belt 161.

Figure 7B:
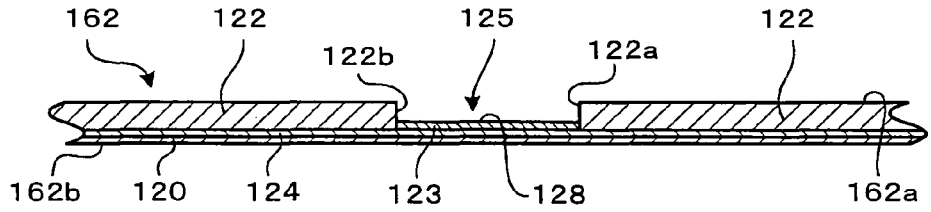

FIG. 7B shows a partial sectional view of a conveyor belt, along the conveyance direction, included in an inkjet printer according to a third embodiment of the present invention. The conveyor belt 162 of FIG. 7B has two ink receiving grooves 125 though only one of them is shown in FIG. 7B. Except the region of each ink receiving groove 125, the conveyor belt 162 has a three-layer structure of an endless base sheet 120 forming the inner circumferential surface 162*b* of the belt 162, an elastic sheet 122 forming the outer circumferential surface 162*a* of the belt 162, and an adhesive layer 124 bonding the two sheets 120 and 122 to each other.

The end faces 122*a* and 122*b* of two elastic sheets 122 opposed to each other stand perpendicularly to the base sheet 120. The adhesive layer 124 is continuous with no separation in each ink receiving groove 125. A reinforcing sheet 123 having a constant thickness is bonded onto the whole area of the adhesive layer 124 within each ink receiving groove 125. The strength of the reinforcing sheet 123 is larger than that of the elastic sheets 122. The reinforcing sheet 123 is preferably made of an elastic member resistive to ink. The thickness of the reinforcing sheet 123 is smaller than that of the elastic sheet 122. The upper surface of the reinforcing sheet 123 forms the bottom face of each ink receiving groove 125, i.e., the receiving groove bottom face 128.

In this embodiment, because the whole area of the base sheet 120 within each ink receiving groove 125 is covered with the adhesive layer 124 and the reinforcing sheet 123, the thickness and strength of the conveyor belt 162 along the conveyance direction do not sharply change at both end portions of each elastic sheet 122. As a result, the change in the conveyance speed of a cut sheet P by the belt 162 when an ink receiving groove 125 passes on a belt roller 22 or 24 attendant upon the rotation of the belt 162 is dull in comparison with a case wherein the area of the base sheet 120 within each ink receiving groove 125 is not covered with the adhesive layer 124 and the reinforcing sheet 123.

A similar effect of making the change in the conveyance speed dull can be obtained even in case that at least part of the area of the base sheet 120 continuous from the front or rear end of each ink receiving groove 125 is covered with one of the adhesive layer 124 and the reinforcing sheet 123. The reinforcing sheet 123 may not always be bonded with the adhesive layer 124. However, when the reinforcing sheet 123 is bonded with the adhesive layer 124, it is easy to obtain the effect of making the change in the conveyance speed dull.

Figure 7C:
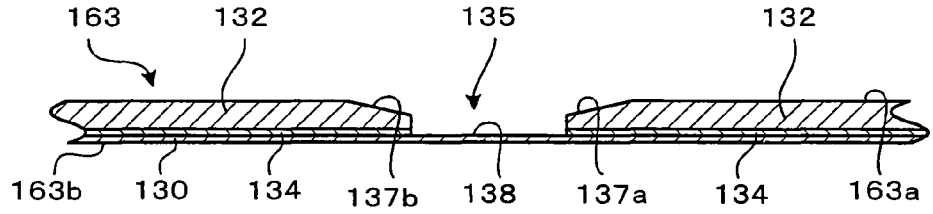

FIG. 7C shows a partial sectional view of a conveyor belt, along the conveyance direction, included in an inkjet printer according to a fourth embodiment of the present invention. The conveyor belt 163 of FIG. 7C has two ink receiving grooves 135 though only one of them is shown in FIG. 7C. Except the region of each ink receiving groove 135, the conveyor belt 163 has a three-layer structure of an endless base sheet 130 forming the inner circumferential surface 163*b* of the belt 163, an elastic sheet 132 forming the outer circumferential surface 163*a* of the belt 163, and an adhesive layer 134 bonding the two sheets 130 and 132 to each other.

The end faces of two elastic sheets 132 opposed to each other stand perpendicularly to the base sheet 130 by a short distance. The end portions of the elastic sheets 132 continuous from the upper edges of the above end faces are formed into taper faces 137*a* and 137*b* each having a constant width and being open outward at an inclination angle of 30 degrees. The adhesive layer 134 does not extend into any ink receiving groove 135. That is, the whole of the adhesive layer 134 is sandwiched by the base sheet 130 and an elastic sheet 132. Thus, the portion of the base sheet 130 exposed between opposed ends of the elastic sheets 132 forms the bottom face of each ink receiving groove 135, i.e., the receiving groove bottom face 138.

In this embodiment, because the end portions of the elastic sheets 132 are formed into the taper faces 137*a* and 137*b*, the thickness and strength of the conveyor belt 163 along the conveyance direction do not sharply change at the boundary between each ink receiving groove 135 and the outside thereof. As a result, the change in the conveyance speed of a cut sheet P by the belt 163 when an ink receiving groove 135 passes on a belt roller 22 or 24 attendant upon the rotation of the belt 163 is dull in comparison with a case wherein the end portions of the elastic sheets 132 are not formed into such taper faces 137*a* and 137*b*.

Figure 7D:
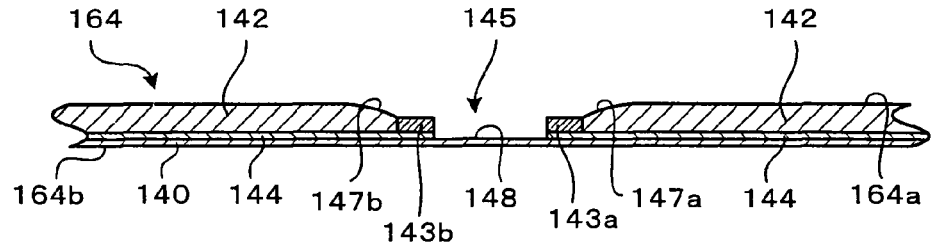

FIG. 7D shows a partial sectional view of a conveyor belt, along the conveyance direction, included in an inkjet printer according to a fifth embodiment of the present invention. The conveyor belt 164 of FIG. 7D has two ink receiving grooves 145 though only one of them is shown in FIG. 7D. Except the region of each ink receiving groove 145, the conveyor belt 164 has a three-layer structure of an endless base sheet 140 forming the inner circumferential surface 164*b* of the belt 164, an elastic sheet 142 forming the outer circumferential surface 164*a* of the belt 164, and an adhesive layer 144 bonding the two sheets 140 and 142 to each other.

The end portions of two elastic sheets 142 opposed to each other are formed into taper faces 147*a* and 147*b* each having a constant width and being open outward at an inclination angle of 30 degrees. Each of the taper faces 147*a* and 147*b* is somewhat curved to be convex upward. The distance between the upper edges of the opposed taper faces 147*a* and 147*b* is larger than the distance between the upper edges of the opposed taper faces 137*a* and 137*b* of the belt 163 of FIG. 7C. End portions of the adhesive layer 144 interposed between the elastic and base sheets 142 and 140 extend beyond the ends of the elastic sheets 142 over the width of the elastic sheets 142. The extensions of the adhesive layer 144 are covered with reinforcing sheets 143*a* and 143*b* each having a constant thickness smaller than the thickness of the elastic sheets 142. The strength of the reinforcing sheets 143*a* and 143*b* is larger than the strength of the elastic sheets 142. The outer circumferential surface of the base sheet 140 is exposed between each pair of opposed extensions of the adhesive layer 144. The exposed portion of the outer circumferential surface of the base sheet 140 forms the bottom face of each ink receiving groove 145, i.e., the receiving groove bottom face 148.

In this embodiment, the end portions of the elastic sheets 142 are formed into the taper faces 147*a* and 147*b*, and the reinforcing sheets 143*a* and 143*b* and the extensions of the adhesive layer 144, which form regions where the thickness of the belt 164 is constant, are continuous from the lower end portions of the taper faces 147*a* and 147*b*. Thus, the thickness and strength of the conveyor belt 164 along the conveyance direction do not sharply change at the boundary between each ink receiving groove 145 and the outside thereof. As a result, the change in the conveyance speed of a cut sheet P by the belt 164 when an ink receiving groove 145 passes on a belt roller 22 or 24 attendant upon the rotation of the belt 164 is duller than that in case of FIG. 7C.

Figure 7E:
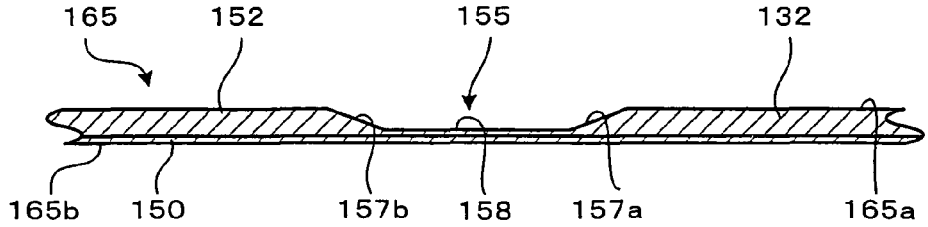

FIG. 7E shows a partial sectional view of a conveyor belt, along the conveyance direction, included in an inkjet printer according to a sixth embodiment of the present invention. The conveyor belt 165 of FIG. 7E has two ink receiving grooves 155 though only one of them is shown in FIG. 7E. In the whole region including the ink receiving grooves 155, the conveyor belt 165 has a two-layer structure of an endless base sheet 150 forming the inner circumferential surface 165*b* of the belt 165, and an elastic sheet 152 forming the outer circumferential surface 165*a* of the belt 165. Part of the outer circumferential surface of the elastic sheet 152 forms the bottom face of each ink receiving groove 155, i.e., the receiving groove bottom face 158. The base sheet 150 and the elastic sheet 152 have been bonded to each other by thermocompression. The thickness of the elastic sheet 152 has been decreased at two portions such that two ink receiving grooves 155 are formed each of which is defined by a thin portion of the elastic sheet 152 and two taper faces 157*a* and 157*b*, each having a constant width and inclined at an angle of 30 degrees, formed on the elastic sheet 152 on both sides of the thin portion.

In this embodiment, because the ink receiving grooves 155 each having the taper faces 157*a* and 157*b* are formed on the elastic sheet 152, the thickness and strength of the conveyor belt 165 along the conveyance direction do not sharply change at the boundary between each ink receiving groove 155 and the outside thereof. As a result, the change in the conveyance speed of a cut sheet P by the belt 165 when an ink receiving groove 155 passes on a belt roller 22 or 24 attendant upon the rotation of the belt 165 is dull.

Seventh to Eleventh Embodiments

Seventh to eleventh embodiments of the present invention will be described. In any of the embodiments, a conveyor belt includes no base sheet. The inkjet printers of the seventh to eleventh embodiments differ from the printer of the first embodiment only in construction of the conveyor belt. Thus, in each of the seventh to eleventh embodiments, the construction of the conveyor belt will be mainly described, and the description of the feature common to the first embodiment will be omitted. In any of the seventh to eleventh embodiments, each ink receiving groove is formed over the width of the conveyor belt.

Figure 8A:
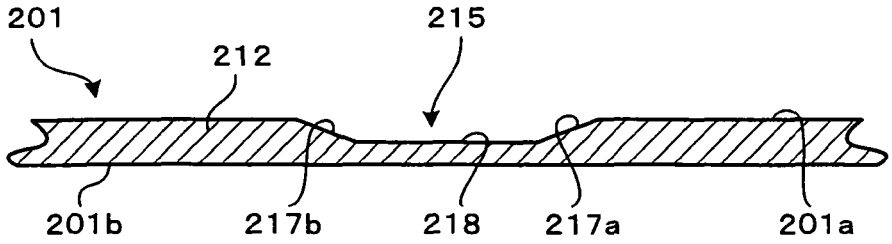
FIGS. 8A to 8E are partial sectional views of conveyor belts along their lengths included in inkjet printers according to seventh to eleventh embodiments of the present invention, respectively.

FIG. 8A shows a partial sectional view of a conveyor belt, along the conveyance direction, included in an inkjet printer according to a seventh embodiment of the present invention. The conveyor belt 201 of FIG. 8A is made of only an endless elastic sheet 212 forming both the outer and inner circumferential surfaces 201*a* and 201*b* of the belt 201. The thickness of the elastic sheet 212 has been decreased at two portions such that two ink receiving grooves 215 are formed each of which is defined by a thin portion of the elastic sheet 212 and two taper faces 217*a* and 217*b*, each having a constant width and inclined at an angle of 30 degrees, formed on the elastic sheet 212 on both sides of the thin portion, though only one ink receiving groove 215 is shown in FIG. 8A. Thus, part of the outer circumferential surface of the elastic sheet 212 forms the bottom face of each ink receiving groove 215, i.e., the receiving groove bottom face 218.

Figure 8B:
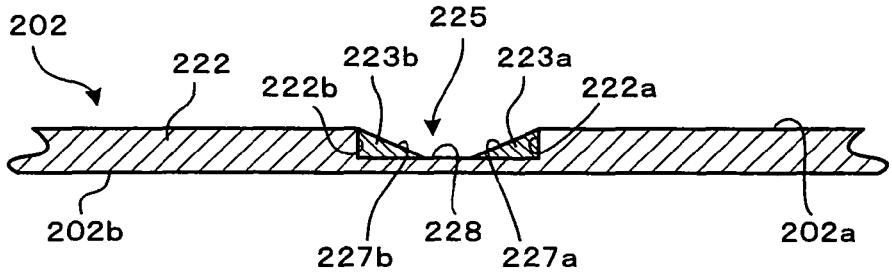

FIG. 8B shows a partial sectional view of a conveyor belt, along the conveyance direction, included in an inkjet printer according to an eighth embodiment of the present invention. The conveyor belt 202 of FIG. 8B has two ink receiving grooves 225 though only one of them is shown in FIG. 8B. Except the region of each ink receiving groove 225, the belt 202 is made of only an endless elastic sheet 222. That is, the elastic sheet 222 forms both the outer and inner circumferential surfaces 202*a* and 202*b* of the belt 202. In each ink receiving groove 225, the elastic sheet 222 has opposed two wall faces 222*a* and 222*b* along the width of the belt 202. The portion of the elastic sheet 222 between the two wall faces 222*a* and 222*b* is thinner than the other portion of the elastic sheet 222.

The wall faces 222*a* and 222*b* and part of the thin portion of the elastic sheet 222 are covered with reinforcing members 223*a* and 223*b* each of which is formed into a triangular prism having the same height as the wall faces 222*a* and 222*b*. The surface of the thin portion of the elastic sheet 222 is exposed between the two reinforcing members 223*a* and 223*b*. Thus, the exposed portion of the surface of the thin portion of the elastic sheet 222 forms the bottom face of each ink receiving groove 225, i.e., the receiving groove bottom face 228. The respective reinforcing members 223*a* and 223*b* have taper faces 227*a* and 227*b* each having a constant width and being inclined at an angle of 30 degrees relatively to the receiving groove bottom face 228. The reinforcing members 223*a* and 223*b* may be made of a rubber material such as EPDM, urethane rubber, or butyl rubber. The strength of the reinforcing members 223*a* and 223*b* is larger than the strength of the elastic sheet 222. The reinforcing members 223*a* and 223*b* may be fixed to the elastic sheet 222 with an adhesive or pins each having a wedge-shaped end to be hard to come out.

Figure 8C:
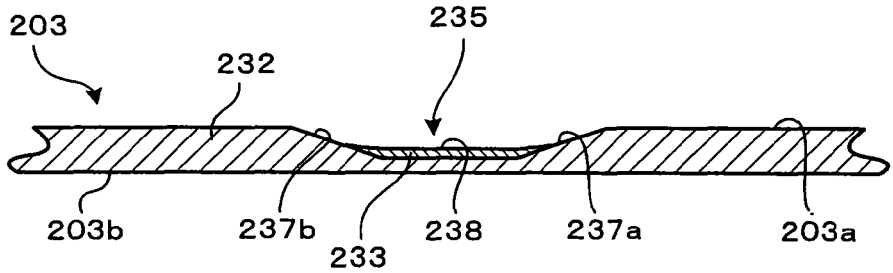

FIG. 8C shows a partial sectional view of a conveyor belt, along the conveyance direction, included in an inkjet printer according to a ninth embodiment of the present invention. Except the region of each ink receiving groove 235, the conveyor belt 203 of FIG. 8C is made of only an endless elastic sheet 232 forming both the outer and inner circumferential surfaces 203*a* and 203*b* of the belt 203. The thickness of the elastic sheet 232 has been decreased at two portions such that two ink receiving grooves 235 are formed each of which is defined by a thin portion of the elastic sheet 232 and two taper faces 237*a* and 237*b*, each having a constant width and inclined at an angle of 30 degrees, formed on the elastic sheet 232 on both sides of the thin portion, though only one ink receiving groove 235 is shown in FIG. 8C. Within each ink receiving groove 235, the portion of the elastic sheet 232 other than the vicinities of the upper edges of the taper faces 237*a* and 237*b* is covered with a thin reinforcing sheet 233. Thus, the upper surface of the reinforcing sheet 233 forms the bottom face of each ink receiving groove 235, i.e., the receiving groove bottom face 238. The thickness of the belt 203 in the region of each ink receiving groove 235 gradually decreases toward the center of the ink receiving groove 235 in the conveyance direction. The strength of the reinforcing sheet 233 is larger than the strength of the elastic sheet 232.

Figure 8D:
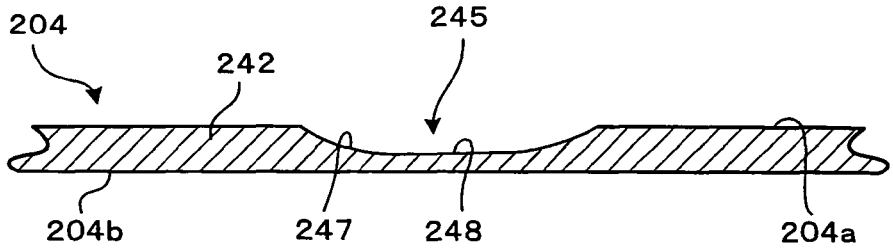

FIG. 8D shows a partial sectional view of a conveyor belt, along the conveyance direction, included in an inkjet printer according to a tenth embodiment of the present invention. The conveyor belt 204 of FIG. 8D is made of only an endless elastic sheet 242 forming both the outer and inner circumferential surfaces 204*a* and 204*b* of the belt 204. The thickness of the elastic sheet 242 has been decreased at two portions such that two ink receiving grooves 245 are formed each of which is defined by curved faces 247 concave downward symmetrically with respect to the center of the ink receiving groove 245 in the conveyance direction, though only one ink receiving groove 245 is shown in FIG. 8D. Thus, part of the outer circumferential surface of the elastic sheet 242 forms the bottom face of each ink receiving groove 245, i.e., the receiving groove bottom face 248. The thickness of the belt 204 in the region of each ink receiving groove 245 gradually decreases toward the center of the ink receiving groove 245 in the conveyance direction.

Figure 8E:
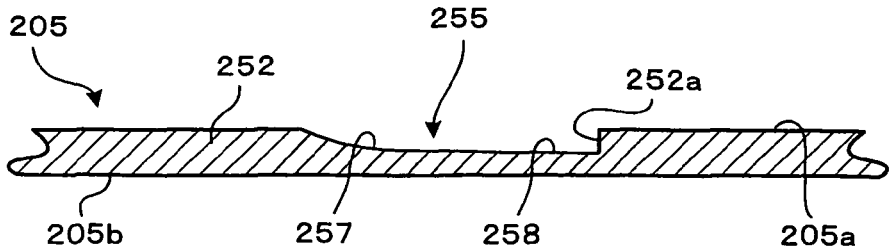

FIG. 8E shows a partial sectional view of a conveyor belt, along the conveyance direction, included in an inkjet printer according to an eleventh embodiment of the present invention. The conveyor belt 205 of FIG. 8E is made of only an endless elastic sheet 252 forming both the outer and inner circumferential surfaces 205*a* and 205*b* of the belt 205. The thickness of the elastic sheet 252 has been decreased at two portions such that two ink receiving grooves 255 are formed each of which is defined by a wall face 252*a* perpendicularly to the conveyance surface and a curved face 257 concave downward and being connected to the bottom edge of the wall face 252*a*, though only one ink receiving groove 255 is shown in FIG. 8E. Thus, the curved face 257 of the elastic sheet 252 forms the bottom face of each ink receiving groove 255, i.e., the receiving groove bottom face 258. The thickness of the belt 205 in the region of each ink receiving groove 255 gradually decreases toward the wall face 252*a*.

In any of the above-described seventh to eleventh embodiments, the taper faces 217*a* and 217*b*; 227*a* and 227*b*; or 237*a* and 237*b*, the curved faces 247, or the curved face 257 is formed in each ink receiving groove 215, 225, 235, 245, or 255. Thus, the thickness and strength of the conveyor belt 201, 202, 203, 204, or 205 along the conveyance direction do not sharply change at the boundary between each ink receiving groove and the outside thereof. As a result, the change in the conveyance speed of a cut sheet P by the belt when an ink receiving groove passes on a belt roller 22 or 24 attendant upon the rotation of the belt is dull in comparison with a case wherein no taper face is formed in the ink receiving groove.

Twelfth to Seventeenth Embodiments

Twelfth to seventeenth embodiments of the present invention will be described. In any of the embodiments, a conveyor belt includes no base sheet and is reinforced by wires. The inkjet printers of the twelfth to seventeenth embodiments differ from the printer of the first embodiment only in construction of the conveyor belt. Thus, in each of the twelfth to seventeenth embodiments, the construction of the conveyor belt will be mainly described, and the description of the feature common to the first embodiment will be omitted. In any of the twelfth to seventeenth embodiments, each ink receiving groove is formed over the width of the conveyor belt.

Figure 9A:
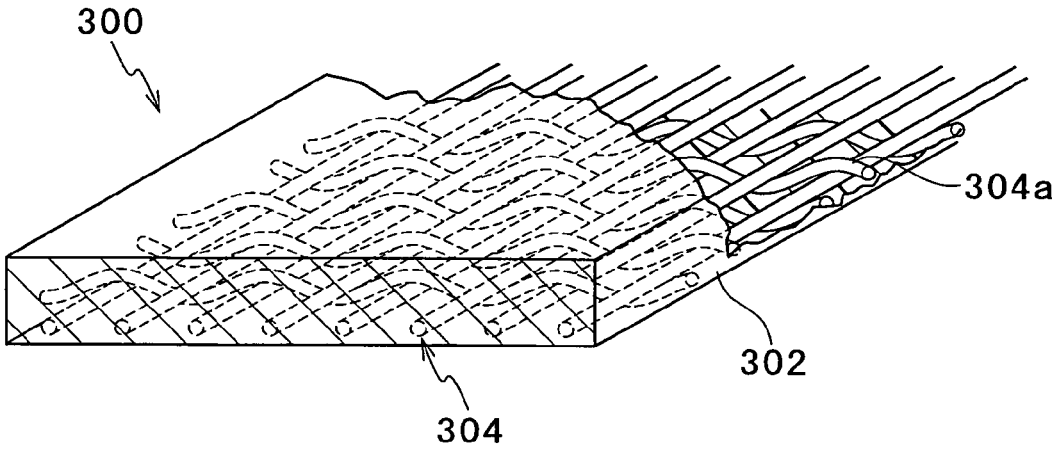
FIG. 9A is a partial transparent perspective view of a conveyor belt included in an inkjet printer according to a twelfth embodiment of the present invention.
Figure 9B:
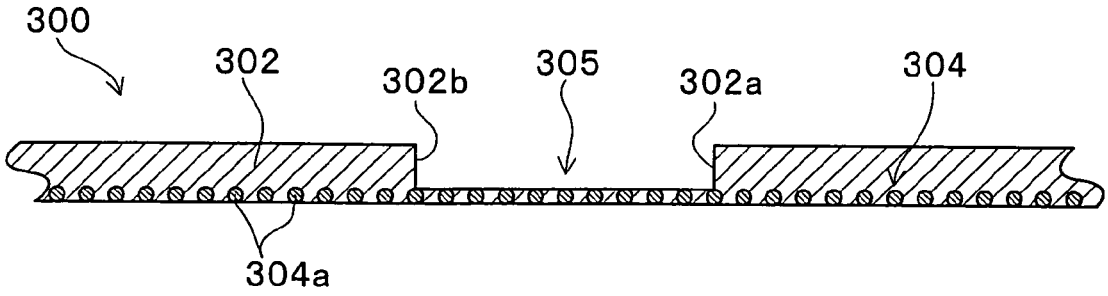
FIG. 9B is a partial sectional view of the conveyor belt of FIG. 9A along its length.

FIG. 9A shows a partial transparent perspective view of a conveyor belt included in an inkjet printer according to a twelfth embodiment of the present invention. FIG. 9B is a partial sectional view of the conveyor belt of FIG. 9A along the conveyance direction. As is apparent from FIGS. 9A and 9B, the conveyor belt 300 of this embodiment is made of an endless elastic sheet 302 in which a metallic net 304 has been embedded over the whole length of the belt 300. The elastic sheet 302 is recessed to form ink receiving grooves 305. In each ink receiving groove 305, the elastic sheet 302 has opposed two wall faces 302*a* and 302*b* along the width of the belt 300. The portion of the elastic sheet 302 between the two wall faces 302*a* and 302*b* is thinner than the other portion of the elastic sheet 302.

The metallic net 304 has been made in the manner that a large number of metallic wires 304*a* are woven into a net. The pitch of metallic wires 304*a* in the metallic net 304 is sufficiently smaller than the width of each ink receiving groove 305 along the conveyance direction. Thus, when the length of the ink receiving groove 305 in the conveyance direction is used as a unit for strength measurement, the strength of the metallic net 304 is substantially constant along the conveyance direction. The strength of the metallic net 304 is larger than the strength of the elastic sheet 302. The diameter of each metallic wire 304*a* is somewhat smaller than the thickness of each thin portion of the elastic sheet 302.

In the printer of this embodiment, because the metallic net 304 stronger than the elastic sheet 302 has been embedded in the elastic sheet 302 of the conveyor belt 300 over the whole length of the belt 300, the strength of the conveyor belt 300 itself is larger than those in the above-described first to eleventh embodiments. Thus, the ratio of the decrease in the strength of the belt 300 at the portion of each ink receiving groove 305 to the strength of the whole of the belt 300 is relatively low. As a result, the conveyance speed of a cut sheet P scarcely varies in accordance with whether or not an ink receiving groove 305 is passing on a belt roller 22 or 24. Further, because the diameter of each metallic wire 304*a* is smaller than the minimum thickness of the elastic sheet 302, i.e., the thickness of each thin portion, the change in the strength of the belt 300 at the region of each ink receiving groove 305, in the conveyance direction, is smaller. As a result, the variation of the conveyance speed of a cut sheet P is less.

In the conveyor belt 300, the metallic net 304 may not have wires 304*a* arranged along the conveyance direction. As the material of each wire 304*a*, other than metal, a fiber material may be used that has proper tensile strength, such as an aramid fiber. The metallic net 304 suffices if it has been embedded across each ink receiving groove 305, and thus the metallic net 304 need not always have been embedded over the whole length of the conveyor belt 300. The diameter of each metallic wire 304*a* may be somewhat larger than the thickness of each thin portion of the elastic sheet 302.

In another modification, a flexible sheet member stronger than the elastic sheet 302 may be used in place of the metallic net 304. In that case, the sheet member may be embedded in the elastic sheet 302 or bonded to the inner circumferential surface of the conveyor belt 300. In still another modification, a base sheet may be used together with the elastic sheet, as shown in FIG. 7E. In that case, the strength of the metallic net is larger than the strength of either of the base and elastic sheets, which are principal components of the conveyor belt. The metallic net 304 may be embedded in the elastic sheet or the base sheet.

In any of thirteenth to sixteenth embodiments, only the construction of each ink receiving groove of the above-described twelfth embodiment is modified. In each of the thirteenth to sixteenth embodiments, therefore, only the difference from the twelfth embodiment will be described. In each of the thirteenth to sixteenth embodiments, the same components as those in the twelfth embodiment are denoted by the same reference numerals as those in the twelfth embodiment, respectively, and the description thereof will be omitted.

Figure 10A:
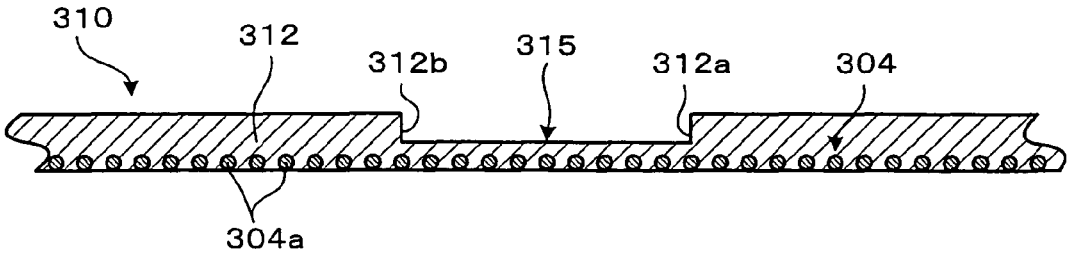
FIGS. 10A to 10D are partial sectional views of conveyor belts along their lengths included in inkjet printers according to thirteenth to sixteenth embodiments of the present invention, respectively.

FIG. 10A shows a sectional view of a conveyor belt 310, along the conveyance direction, included in an inkjet printer according to a thirteenth embodiment of the present invention, in the vicinity of an ink receiving groove 315. In the ink receiving groove 315, an elastic sheet 312 has opposed two wall faces 312*a* and 312*b* along the width of the belt 310. The portion of the elastic sheet 312 between the wall faces 312*a* and 312*b* is thinner than the other portion of the elastic sheet 312. As is apparent from FIG. 10A, the thickness of the thin portion of the ink receiving groove 315 formed on the elastic sheet 312 forming the conveyor belt 301 is approximately twice the diameter of each metallic wire 304*a* of the metallic net 304. In the belt 310, therefore, the difference in strength between the region of the ink receiving groove and the other region is less than that in the belt 300 of FIGS. 9A and 9B.

Figure 10B:
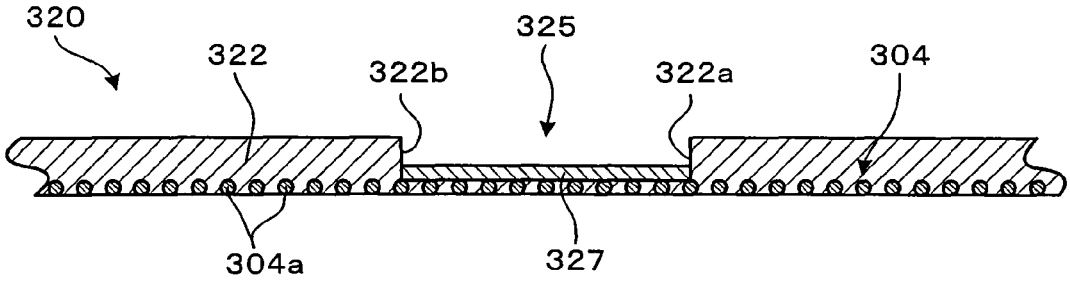

FIG. 10B shows a sectional view of a conveyor belt 320, along the conveyance direction, included in an inkjet printer according to a fourteenth embodiment of the present invention, in the vicinity of an ink receiving groove 325. In the ink receiving groove 325, an elastic sheet 322 has opposed two wall faces 322*a* and 322*b* along the width of the belt 320. The height of the wall faces 322*a* and 322*b* is the same as the height of the wall faces 302*a* and 302*b* shown in FIG. 9B. That is, the thickness of the thin portion of the elastic sheet 322 is somewhat larger than the diameter of each metallic wire 304*a*. A reinforcing sheet 327 having its thickness smaller than the height of the wall faces 322*a* and 322*b* is disposed on the whole area of the thin portion of the elastic sheet 322. The strength of the reinforcing sheet 327 is larger than the strength of the elastic sheet 322. In this embodiment, therefore, the change in strength of the belt at the ink receiving groove 325 in the conveyance direction is less than that in the embodiment of FIG. 10A.

In this embodiment, the strength of the metallic net 304 is larger than the strength of the reinforcing sheet 327. However, because such a reinforcing sheet 327 disposed only within each ink receiving groove 325 is considered not to be a principal component of the conveyor belt 320, even if the strength of the metallic net 304 is smaller than the strength of the reinforcing sheet 327, the change in strength of the belt 320 at the ink receiving groove 325 in the conveyance direction can be made very little.

Figure 10C:
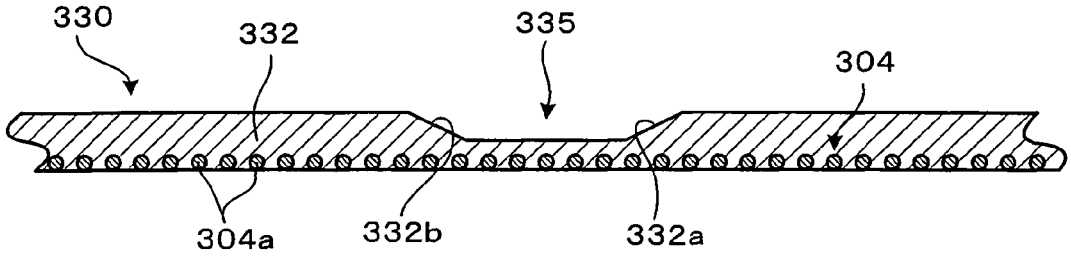

FIG. 10C shows a sectional view of a conveyor belt 330, along the conveyance direction, included in an inkjet printer according to a fifteenth embodiment of the present invention, in the vicinity of an ink receiving groove 335. On an elastic sheet 332 forming the conveyor belt 330 of FIG. 10C, an ink receiving groove 335 is formed that is defined by a thin portion of the elastic sheet 332 and two taper faces 332*a* and 332*b*, each having a constant width and being inclined at an angle of 30 degrees, formed on both sides of the thin portion. The thickness of the thin portion of the ink receiving groove 335 is approximately twice the diameter of each metallic wire 304*a* of the metallic net 304. In the belt 330, therefore, the difference in strength between the region of the ink receiving groove and the other region is less than that in the belt 300 of FIGS. 9A and 9B. In addition, because the taper faces 332*a* and 332*b* are formed in the ink receiving groove 335, the thickness and strength of the conveyor belt 330 along the conveyance direction do not sharply change at the boundary between the ink receiving groove 335 and the outside thereof. As a result, the change in the conveyance speed of a cut sheet P by the belt 330 when the ink receiving groove 335 passes on a belt roller 22 or 24 attendant upon the rotation of the belt 330 is dull in comparison with a case wherein no taper face is formed in the ink receiving groove like the embodiments of FIGS. 10A and 10B. In this embodiment, only one of the taper faces 332*a* and 332*b* may be formed.

Figure 10D:
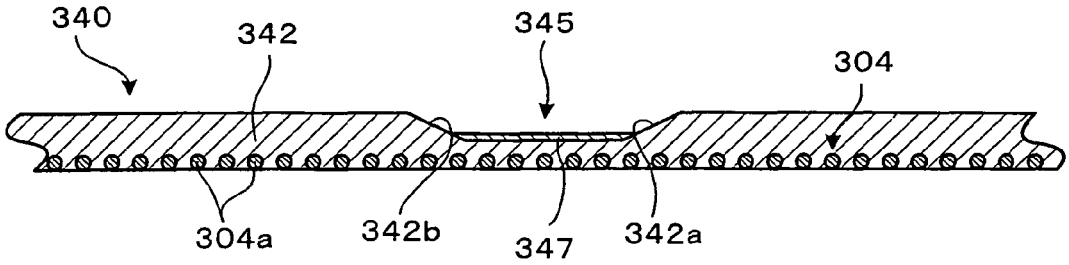

FIG. 10D shows a sectional view of a conveyor belt 340, along the conveyance direction, included in an inkjet printer according to a sixteenth embodiment of the present invention, in the vicinity of an ink receiving groove 345. On an elastic sheet 342 forming the conveyor belt 340 of FIG. 10D, an ink receiving groove 345 is formed that is defined by a thin portion of the elastic sheet 342 and two taper faces 342*a* and 342*b*, each having a constant width and being inclined at an angle of 30 degrees, formed on both sides of the thin portion. The thickness of the thin portion of the ink receiving groove 345 is somewhat larger than the diameter of each metallic wire 304*a* of the metallic net 304. The portion of the elastic sheet 342 within the ink receiving groove 345 is covered with a thin reinforcing sheet 347 except the vicinities of the upper edges of the taper faces 342*a* and 342*b*. The thickness of the belt 340 in the region of the ink receiving groove 345 gradually decreases toward the center of the ink receiving groove 345 in the conveyance direction. The strength of the reinforcing sheet 347 is larger than the strength of the elastic sheet 342. In this embodiment, therefore, the change in the conveyance speed of a cut sheet P is duller than that in a case wherein the thin portion of the ink receiving groove 345 is covered with no such reinforcing sheet 347, like the embodiment of FIG. 10C.

In this embodiment, the strength of the metallic net 304 is larger than the strength of the reinforcing sheet 347. However, because such a reinforcing sheet 347 disposed only within each ink receiving groove 345 is considered not to be a principal component of the conveyor belt 340, even if the strength of the metallic net 304 is smaller than the strength of the reinforcing sheet 347, the change in strength of the belt 340 at the ink receiving groove 345 in the conveyance direction can be made very little.

Figure 11:
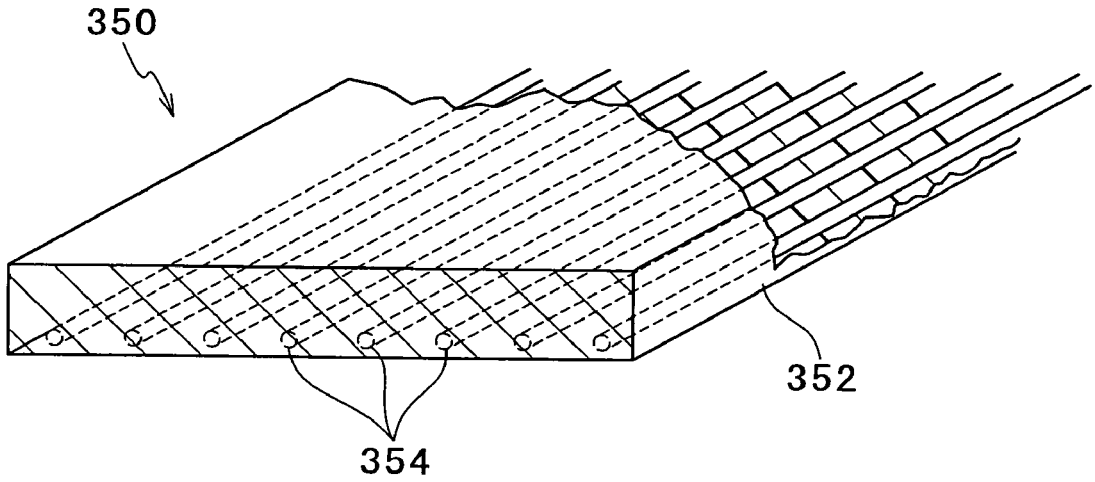
FIG. 11 is a partial transparent perspective view of a conveyor belt included in an inkjet printer according to a seventeenth embodiment of the present invention.

FIG. 11 shows a partial transparent perspective view of a conveyor belt included in an inkjet printer according to a seventeenth embodiment of the present invention. The conveyor belt 350 of FIG. 11 is made of an endless elastic sheet 352 in which metallic wires 354 have been embedded over the whole length of the belt 350. The strength of the assemblage of the metallic wires 354 is larger than the strength of the elastic sheet 352. The metallic wires 354 extending along the length of the belt 350 parallel to one another are arranged at regular intervals. That is, the metallic wires 354 form stripes extending along the length of the belt 350. On the elastic sheet 352, ink receiving grooves each having the same shape as the ink receiving groove shown in FIG. 9B are formed though any ink receiving groove is not shown in FIG. 11.

In the printer of this embodiment, because the assemblage of the metallic wires 354 stronger than the elastic sheet 352 has been embedded in the elastic sheet 352 of the conveyor belt 350 over the whole length of the belt 350, the strength of the conveyor belt 350 itself is larger than those in the above-described first to eleventh embodiments. Thus, the ratio of the decrease in the strength of the belt 350 at the portion of each ink receiving groove to the strength of the whole of the belt 350 is relatively low. As a result, the conveyance speed of a cut sheet P scarcely varies in accordance with whether or not an ink receiving groove is passing on a belt roller 22 or 24.

In modifications of this embodiment, the construction of each ink receiving groove may be changed from that of FIG. 9B into any of those of FIGS. 10A to 10D.

In each of the above-described twelfth to seventeenth embodiments, either of the front and rear ends of each ink receiving groove extends along the width of the belt. However, at least one of the front and rear ends of each ink receiving groove may be oblique relatively to the width of the belt.

Eighteenth to Twentieth Embodiments

Figure 12A:
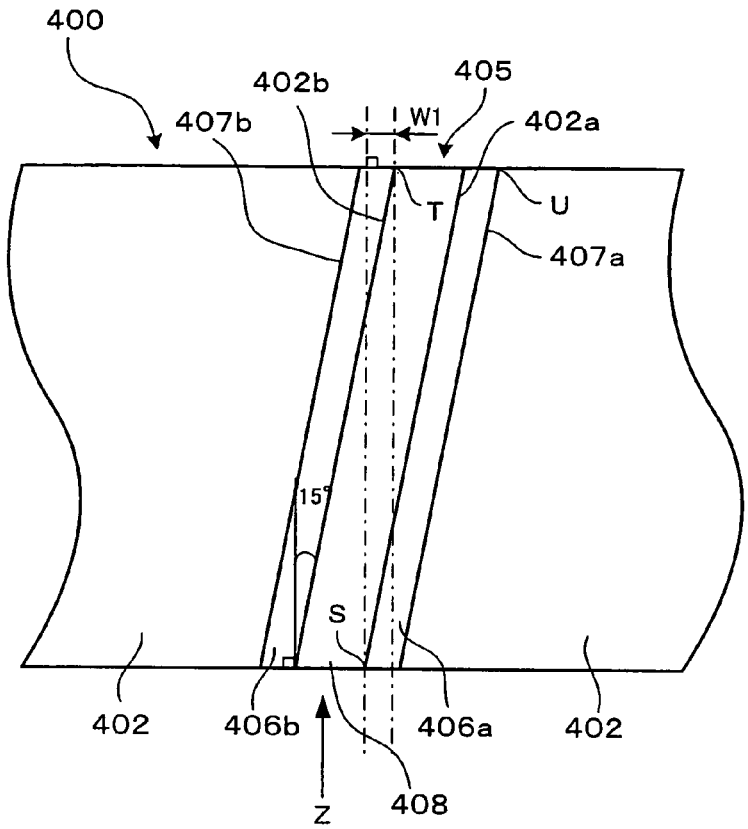
FIG. 12A is a plan view of a conveyor belt of an inkjet printer according to an eighteenth embodiment of the present invention in the vicinity of an ink receiving groove.
Figure 12B:
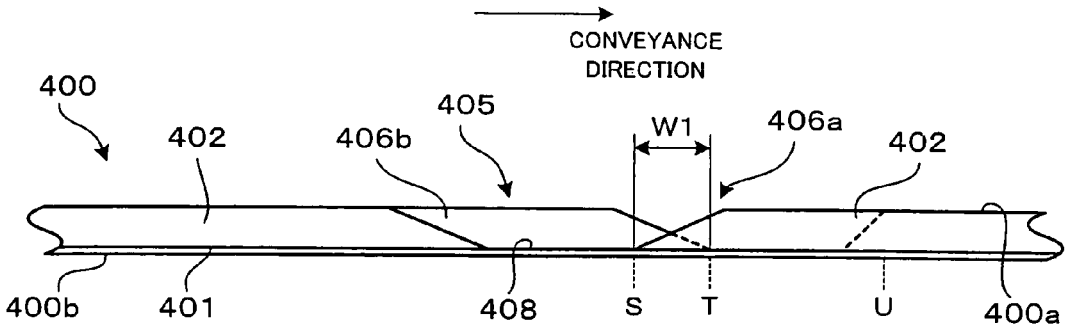
FIG. 12B is a side view of the conveyor belt of FIG. 12A in the vicinity of the ink receiving groove.

Eighteenth to twentieth embodiments of the present invention will be described. The inkjet printers of the eighteenth to twentieth embodiments differ from the printer of the first embodiment only in construction of the conveyor belt. Thus, in each of the eighteenth to twentieth embodiments, the construction of the conveyor belt will be mainly described, and the description of the feature common to the first embodiment will be omitted FIG. 12A is a plan view of a conveyor belt 400 of an inkjet printer according to an eighteenth embodiment of the present invention in the vicinity of an ink receiving groove 405. FIG. 12B is a side view of the conveyor belt 400 in the vicinity of the ink receiving groove 405 when viewing the conveyor belt 400 from the direction indicated by an arrow Z in FIG. 12A. The conveyor belt 400 is made up of an endless base sheet 401 and two separate elastic sheets 402 bonded to the outer circumferential surface of the base sheet 401 by thermocompression.

As shown in FIG. 12B, except the region of each ink receiving groove 405, the conveyor belt 400 has a two-layer structure of the base sheet 401 forming the inner circumferential surface 400*b* of the belt 400 and an elastic sheet 402 forming the outer circumferential surface 400*a* of the belt 400.

As shown in FIG. 12A, each ink receiving groove 405 is formed over the width of the conveyor belt 400. The respective rear and front edges 402*a* and 402*b* of the elastic sheets 402 in the conveyor direction form straight lines inclined at 15 degrees relatively to the width of the belt 400 and parallel to each other. In the vicinity of each of the edges 402*a* and 402*b*, a taper face is formed that has a constant width and is inclined outward at an angle of 30 degrees. Therefore, the front and rear ends 407*a* and 407*b* defining the region of each ink receiving groove 405 are straight lines also inclined at 15 degrees relatively to the width of the belt 400 and parallel to each other.

Two elastic sheets 402 are disposed such that their ends, i.e., the opposed edges 402*a* and 402*b* in each pair, are distant from each other. The taper faces near the edges 402*a* and 402*b* of the elastic sheets 402 form end faces of each ink receiving groove 405, i.e., the receiving groove end faces 406*a* and 406*b*. The portion of the outer circumferential surface of the base sheet 401 exposed between the elastic sheets 402 forms the bottom face of each ink receiving groove 405, i.e., the receiving groove bottom face 408.

As shown in FIG. 12B, the leading point T in the receiving groove end face 406*b* in the conveyance direction, which is the intersection of the edge 402*b* with one side face of the belt 400, is distant upstream in the conveyance direction by a distance $W_1$ from the rearmost point S in the receiving groove end face 406*a* in the conveyance direction, which is the intersection of the edge 402*a* with the other side face of the belt 400. That is, the receiving groove end faces 406*a* and 406*b* are partially overlapping each other in the conveyance direction.

The thickness of the belt 400 in the region of each ink receiving groove 405 is the largest at the ends 407*a* and 407*b*. The thickness linearly decreases in the regions of the receiving groove end faces 406*a* and 406*b* from the ends 407*a* and 407*b* to the edges 402*a* and 402*b*. The thickness is equal to the thickness of the base sheet 401 in the region of the receiving groove bottom face 408. In short, in either of the regions from the front end 407*a* to the edge 402*a* and from the rear end 407*b* to the edge 402*b*, the thickness of the belt 400 in the region of the ink receiving groove 405 gradually decreases toward the center of the ink receiving groove 405 in the conveyance direction, i.e., toward the deepest portion of the ink receiving groove 405. The strength of the belt 400 along the conveyance direction changes like the thickness of the belt 400.

In this embodiment, because both the ends 407*a* and 407*b* of each ink receiving groove 405 are inclined relatively to the width of the belt 400, attendant upon the rotation of the belt 400, the ink receiving groove 405 gradually comes on a belt roller 22 or 24 from the leading point U in the ink receiving groove 405 in the conveyance direction, which is the intersection of the end 407*a* with one side face of the belt 400. Therefore, the change in the conveyance speed of a cut sheet P by the belt 400 when the ink receiving groove 405 passes on the belt roller 22 or 24 is very dull.

Further, in this embodiment, the receiving groove end faces 406*a* and 406*b* are partially overlapping each other in the conveyance direction. Thus, before the rearmost point S in the receiving groove end face 406*a* in the conveyance direction comes on the belt roller 22 or 24, the leading point T in the receiving groove end face 406*b* in the conveyance direction comes on the belt roller 22 or 24. As a result, the change in the strength of the belt 400 along the conveyance direction when the ink receiving groove 405 passes on the belt roller 22 or 24 can be made less, and the change in the conveyance speed of a cut sheet P can be reduced more effectively.

In case that the two ends 407*a* and 407*b* defining each ink receiving groove 405 are inclined relatively to the width of the belt 400 as in this embodiment, if ink ejection ports arranged along the width of the belt 400 eject ink all at once in a flushing operation, ink may adhere to a portion of the belt 400 outside the target ink receiving groove 405. In particular, in case that the receiving groove end faces 406*a* and 406*b* are partially overlapping each other in the conveyance direction, the probability increases. In the flushing operation, therefore, the timings for ink ejection by the ink ejection ports arranged along the width of the belt 400 must be staggered.

The angle of inclination of the ends 407*a* and 407*b* relative to the width of the belt 400 is not limited to 15 degrees. The ends 407*a* and 407*b* may be inclined at another angle. In addition, the receiving groove end faces 406*a* and 406*b* may not at all be overlapping each other in the conveyance direction. Further, only one of the ends 407*a* and 407*b* may be inclined relatively to the width of the belt 400.

Figure 13A:
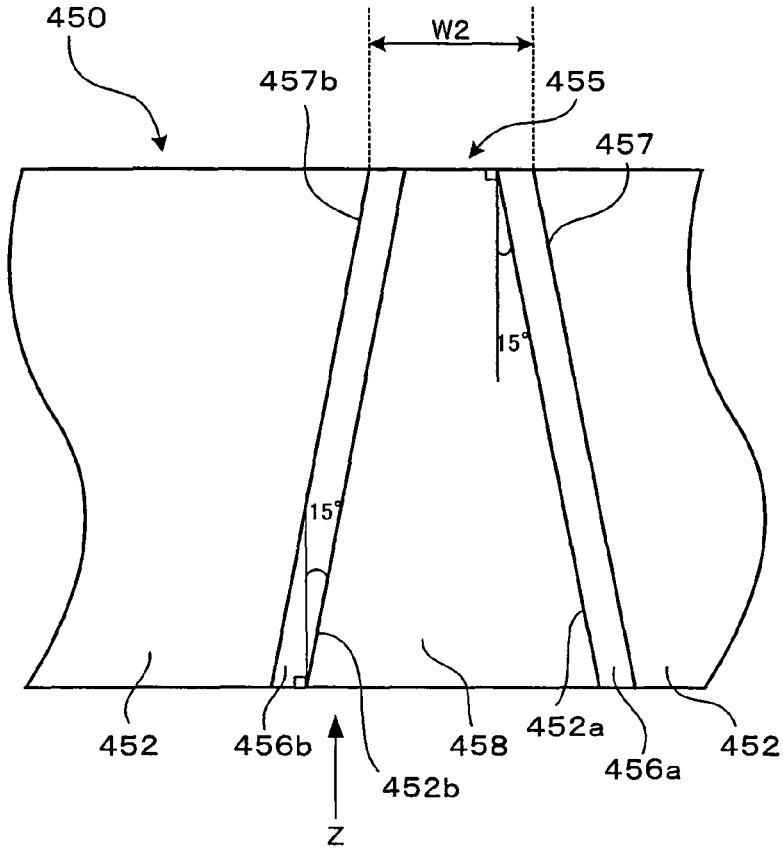
FIG. 13A is a plan view of a conveyor belt of an inkjet printer according to a nineteenth embodiment of the present invention in the vicinity of an ink receiving groove.
Figure 13B:
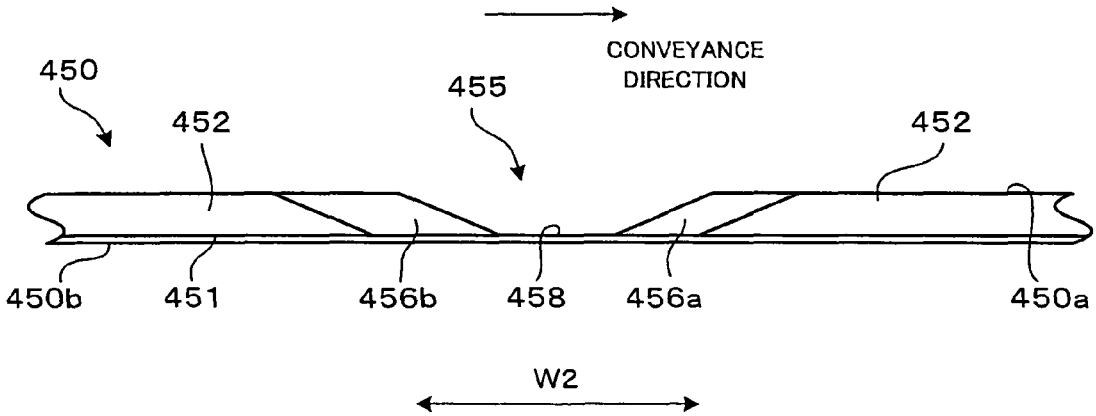
FIG. 13B is a side view of the conveyor belt of FIG. 13A in the vicinity of the ink receiving groove.

FIG. 13A is a plan view of a conveyor belt 450 of an inkjet printer according to a nineteenth embodiment of the present invention in the vicinity of an ink receiving groove 455. FIG. 13B is a side view of the conveyor belt 450 in the vicinity of the ink receiving groove 455 when viewing the conveyor belt 450 from the direction indicated by an arrow Z in FIG. 13A. The conveyor belt 450 is made up of an endless base sheet 451 and two separate elastic sheets 452 bonded to the outer circumferential surface of the base sheet 451 by thermocompression.

As shown in FIG. 13B, except the region of each ink receiving groove 455, the conveyor belt 450 has a two-layer structure of the base sheet 451 forming the inner circumferential surface 450*b* of the belt 450 and an elastic sheet 452 forming the outer circumferential surface 450*a* of the belt 450.

As shown in FIG. 13A, each ink receiving groove 455 is formed over the width of the conveyor belt 450. The rear and front edges 452*a* and 452*b* of the elastic sheets 452 in the conveyor direction form straight lines inclined contrariwise at 15 degrees relatively to the width of the belt 450. In the vicinity of each of the edges 452*a* and 452*b*, a taper face is formed that has a constant width and is inclined outward at an angle of 30 degrees. Therefore, the front and rear ends 457*a* and 457*b* defining the region of each ink receiving groove 455 are straight lines parallel to the respective edges 452*a* and 452*b*, and thus they are also inclined contrariwise at 15 degrees relatively to the width of the belt 450.

Two elastic sheets 452 are disposed such that their opposed edges 452*a* and 452*b* in each pair, are distant from each other. The taper faces near the edges 452*a* and 452*b* of the elastic sheets 452 form end faces of each ink receiving groove 455, i.e., the receiving groove end faces 456*a* and 456*b*. The portion of the outer circumferential surface of the base sheet 451 exposed between the elastic sheets 452 forms the bottom face of each ink receiving groove 455, i.e., the receiving groove bottom face 458. As shown in FIG. 13A, the receiving groove bottom face 458 is trapezoidal in plane because the receiving groove end faces 456*a* and 456*b* are inclined contrariwise at 15 degrees relatively to the width of the belt 450.

The thickness of the belt 450 in the region of each ink receiving groove 455 is the largest at the ends 457*a* and 457*b*. The thickness linearly decreases in the regions of the receiving groove end faces 456*a* and 456*b* from the ends 457*a* and 457*b* to the edges 452*a* and 452*b*. The thickness is equal to the thickness of the base sheet 451 in the region of the receiving groove bottom face 458. In short, in either of the regions from the front end 457*a* to the edge 452*a* and from the rear end 457*b* to the edge 452*b*, the thickness of the belt 450 in the region of the ink receiving groove 455 gradually decreases toward the center of the ink receiving groove 455 in the conveyance direction, i.e., toward the deepest portion of the ink receiving groove 455. The strength of the belt 450 along the conveyance direction changes like the thickness of the belt 450.

In this embodiment, because both the ends 457*a* and 457*b* of each ink receiving groove 455 are inclined relatively to the width of the belt 450, the change in the strength of the conveyor belt 450 along the conveyance direction can be made dull, similarly to the eighteenth embodiment. In addition, because ink ejection ports arranged along the width of the belt 450 can eject ink all at once in a flushing operation, an effect can be obtained that ink ejection control in such a flushing operation is easy. Further, because the receiving groove end faces 456*a* and 456*b* are inclined contrariwise at 15 degrees relatively to the width of the belt 450, the minimum length $W_2$ of each ink receiving groove 455 in the conveyance direction is longer than those in the first and eighteenth embodiments. Thus, because the number of nozzles that eject ink at once in a flushing operation can be increased, the flushing operation can be completed in a short time.

Figure 14A:
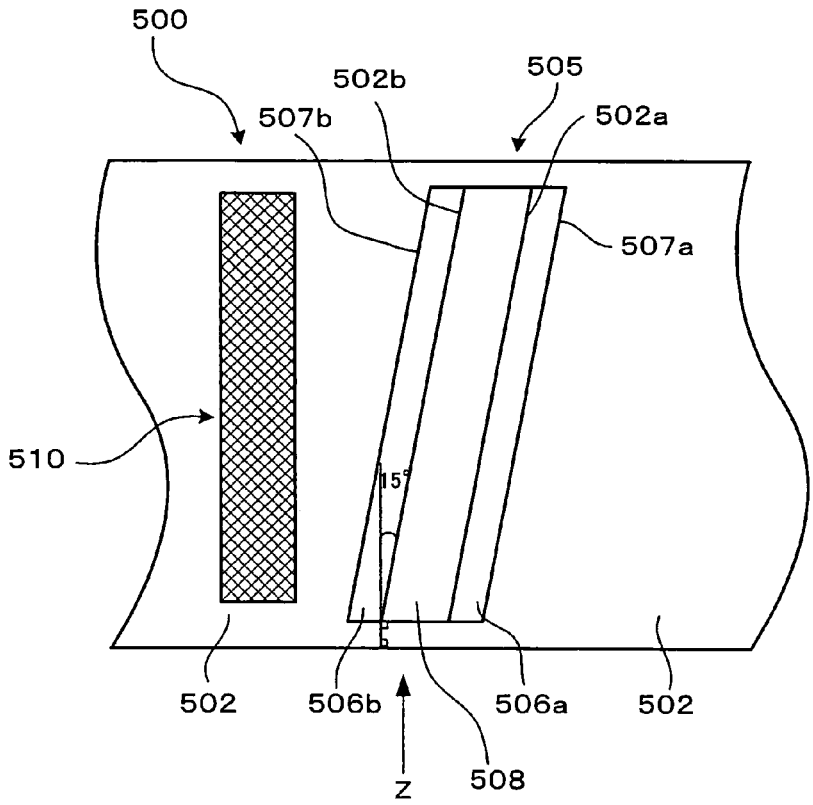
FIG. 14A is a plan view of a conveyor belt of an inkjet printer according to a twentieth embodiment of the present invention in the vicinity of an ink receiving groove.
Figure 14B:
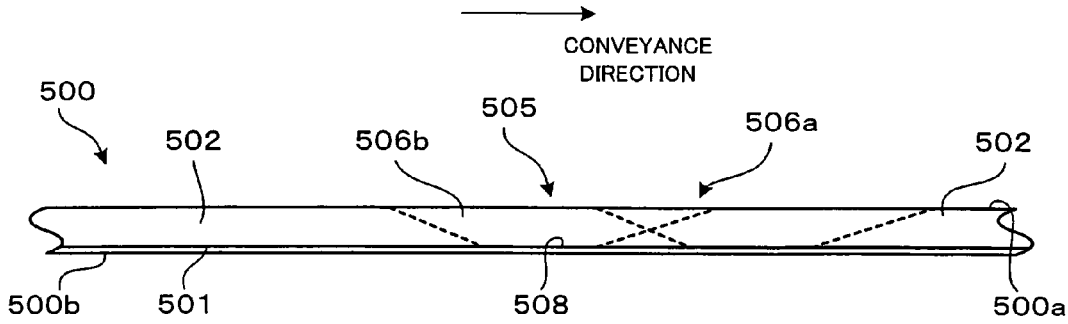
FIG. 14B is a side view of the conveyor belt of FIG. 14A in the vicinity of the ink receiving groove.

FIG. 14A is a plan view of a conveyor belt 500 of an inkjet printer according to a twentieth embodiment of the present invention in the vicinity of an ink receiving groove 505. FIG. 14B is a side view of the conveyor belt 500 in the vicinity of the ink receiving groove 505 when viewing the conveyor belt 500 from the direction indicated by an arrow Z in FIG. 14A. The conveyor belt 500 is made up of an endless base sheet 501 and an elastic sheet 502 bonded to the outer circumferential surface of the base sheet 501 by thermocompression.

As shown in FIG. 14A, in this embodiment, each ink receiving groove 505 is formed partially in the width of the conveyor belt 500. More specifically, each ink receiving groove 505 is formed only in a middle region other than both side portions of the conveyor belt 500. The length of each ink receiving groove 505 along the width of the belt 500 is larger than the length of an ink ejection area 510, to which ink is ejected from heads in a flushing operation, shown in FIG. 14A for reference. In FIG. 14A, the ink ejection area 510 is shown merely for the purpose of illustrating its position in the width of the belt 500. The ink ejection area 510 may be at an arbitrary position in the conveyance direction. As is apparent from FIG. 14A, as for the length along the width of the belt 500, each ink receiving groove 505 can include therein the ink ejection area 510. As shown in FIG. 14B, except the region of each ink receiving groove 505, the conveyor belt 500 has a two-layer structure of the base sheet 501 forming the inner circumferential surface 500*b* of the belt 500 and the elastic sheet 502 forming the outer circumferential surface 500*a* of the belt 500.

As shown in FIG. 14A, a parallelogrammic opening cooperating with the outer circumferential surface of the base sheet 501 to define each ink receiving groove 505 is formed in the elastic sheet 502. The length of the opening along the width of the belt 500 is somewhat smaller than the width of the belt 500. In the vicinities of the respective front and rear ends of the opening in the conveyance direction, taper faces are formed that have a constant width and are inclined parallel at 15 degrees relatively to the width of the belt 500. The taper faces form end faces of each ink receiving groove 505, i.e., the receiving groove end faces 506*a* and 506*b*. The portion of the outer circumferential surface of the base sheet 501 exposed in the elastic sheet 502 forms the bottom face of each ink receiving groove 505, i.e., the receiving groove bottom face 508. At both ends of the opening with respect to the width of the belt 500, there are formed wall faces perpendicular to the outer circumferential surface of the base sheet 501.

The respective front and rear lower edges 502*a* and 502*b* of the opening in the conveyor direction form straight lines inclined at 15 degrees relatively to the width of the belt 500 and parallel to each other. Therefore, the front and rear ends 507*a* and 507*b* defining the region of each ink receiving groove 505 are straight lines also inclined at 15 degrees relatively to the width of the belt 500 and parallel to each other.

The thickness of the belt 500 in the region of each ink receiving groove 505 is the largest at the ends 507*a* and 507*b*. The thickness linearly decreases in the regions of the receiving groove end faces 506*a* and 506*b* from the ends 507*a* and 507*b* to the edges 502*a* and 502*b*. The thickness is equal to the thickness of the base sheet 501 in the region of the receiving groove bottom face 508. In short, in either of the regions from the front end 507*a* to the edge 502*a* and from the rear end 507*b* to the edge 502*b*, the thickness of the belt 500 in the region of the ink receiving groove 505 gradually decreases toward the center of the ink receiving groove 505 in the conveyance direction, i.e., toward the deepest portion of the ink receiving groove 505. The strength of the belt 500 along the conveyance direction changes like the thickness of the belt 500.

In this embodiment, because the width of each ink receiving groove 505 is smaller than the whole width of the belt 500, the ratio of the decrease in the strength of the belt 500 at both ends of the ink receiving groove 505 in the conveyance direction is very low. Thus, the change in the conveyance speed of a cut sheet P by the belt 500 when an ink receiving groove 505 passes on a belt roller 22 or 24 attendant upon the rotation of the belt 500 is dull in comparison with a case wherein each ink receiving groove is formed over the whole width of the belt as in the embodiment of FIGS. 12A and 12B.

Further, in this embodiment, because each ink receiving groove 505 includes therein the ink ejection area 510 with respect to the width of the belt 500, ink ejection ports arranged along the width of the belt 500 can eject ink all at once in a flushing operation. This brings about an effect that ink ejection control in a flushing operation is easy.

Any of the belt shapes as has been described in the eighteenth to twentieth embodiments is applicable to any of the above-described first to seventeenth embodiments.

[Other Modifications]

In the above-described embodiments, the region continuous from the front and/or rear end of each ink receiving groove may be formed into a curved face in place of a taper face. In another modification, steps may be formed in the region continuous from the front and/or rear end of each ink receiving groove so that the depth of the ink receiving groove gradually increases toward the center of the ink receiving groove.

The ink ejection face of each head may not be disposed horizontally or vertically. The ink ejection face may be disposed at an arbitrary angle with a horizontal plane. The material of each component of the conveyor belt can be adequately changed in accordance with circumstances of designing. The number of heads included in the printer is not limited to four. Further, the printer is not limited to a color printer. The present invention is applicable also to, for example, an inkjet type facsimile or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet printer comprising:

an inkjet head;

a pair of rollers whose axes of rotation are parallel to each other; and an endless conveyor belt stretched between the pair of rollers for conveying a print medium in the conveyance direction attendant upon rotations of the pair of rollers, the conveyor belt having, in its outer circumferential surface, an ink receiving groove extending in a direction intersecting the conveyance direction and having a bottom face without an aperture, the conveyor belt further having a first reinforcing member extending in the conveyance direction across the ink receiving groove such that the first reinforcing member overlaps the ink receiving groove and passes through between the bottom face of the ink receiving groove and an inner circumferential surface of the conveyor belt, and having a constant strength along the conveyance direction.

2. The inkjet printer according to claim 1, wherein the first reinforcing member comprises a plurality of wires embedded in the conveyor belt.

3. The inkjet printer according to claim 2, wherein the plurality of wires form one of a mesh shape and a stripe shape along the conveyance direction in the conveyor belt.

4. The inkjet printer according to claim 2, wherein the diameter of each wire is smaller than the minimum thickness of the conveyor belt in the region of the ink receiving groove.

5. The inkjet printer according to claim 1, wherein the conveyor belt further has one or more second reinforcing members in at least one of regions continuous from front and rear ends of the ink receiving groove in the conveyance direction.

6. The inkjet printer according to claim 1, wherein the depth of the ink receiving groove gradually increases toward the center of the ink receiving groove in the conveyance direction in at least one of regions continuous from front and rear ends of the ink receiving groove in the conveyance direction.

7. The inkjet printer according to claim 6, wherein the thickness of the conveyor belt in the region of the ink receiving groove gradually decreases from the front and rear ends toward the center of the ink receiving groove in the conveyance direction.

8. The inkjet printer according to claim 7, wherein at least one of the front and rear ends defining the ink receiving groove extends in a direction intersecting the width of the conveyor belt, and the regions continuous from the respective front and rear ends, where the thickness of the conveyor belt is decreasing, are overlapping each other in the conveyance direction.

9. The inkjet printer according to claim 1, wherein either of front and rear ends defining the ink receiving groove extends along the width of the conveyor belt.

10. The inkjet printer according to claim 1, wherein at least one of front and rear ends defining the ink receiving groove extends in a direction intersecting the width of the conveyor belt.

11. The inkjet printer according to claim 1, wherein either of front and rear ends defining the ink receiving groove extends in a direction intersecting the width of the conveyor belt.

12. The inkjet printer according to claim 1, wherein the ink receiving groove is formed over the whole width of the conveyor belt.

13. The inkjet printer according to claim 1, wherein the ink receiving groove has a width smaller than that of the conveyor belt.

14. The inkjet printer according to claim 13, wherein the length of the ink receiving groove along the width of the conveyor belt is longer than an ink ejection area upon ink preliminary ejection from an inkjet head or heads.

15. The inkjet printer according to claim 1, wherein the first reinforcing member completely covers the bottom face of the ink receiving groove.

* * * * *